US005934076A

United States Patent [19]

Coney

[11] Patent Number: 5,934,076

[45] Date of Patent: Aug. 10, 1999

[54] HEAT ENGINE AND HEAT PUMP

[75] Inventor: Michael Willoughby Essex Coney, Swindon, United Kingdom

[73] Assignee: National Power PLC, London, United Kingdom

[21] Appl. No.: 08/446,843

[22] PCT Filed: Dec. 1, 1993

[86] PCT No.: PCT/GB93/02472

§ 371 Date: Jun. 1, 1995

§ 102(e) Date: Jun. 1, 1995

[87] PCT Pub. No.: WO94/12785

PCT Pub. Date: Jun. 9, 1994

[30] Foreign Application Priority Data

Dec. 1, 1992 [GB] United Kingdom ..... 9225103

[51] Int. Cl.[6] ..... F02G 3/00

[52] U.S. Cl. ..... 60/617

[58] Field of Search ..... 123/68, 70 R; 60/616, 617, 618

[56] References Cited

U.S. PATENT DOCUMENTS

| | | | |
|---|---|---|---|
| 1,381,294 | 6/1921 | French | 123/68 |
| 3,103,780 | 9/1963 | Tryhorn | 60/616 |
| 3,608,311 | 9/1971 | Roesel | 60/516 |
| 3,879,945 | 4/1975 | Summers | 60/522 |
| 3,932,987 | 1/1976 | Munzinger | 60/39.05 |
| 3,998,049 | 12/1976 | McKinley et al. | 60/39.55 |
| 4,040,400 | 8/1977 | Kiener | 123/68 |
| 4,148,195 | 4/1979 | Gerstmann et al. | 62/6 |
| 4,195,481 | 4/1980 | Gregory | 60/516 |
| 4,476,821 | 10/1984 | Robinson et al. | 123/68 |
| 4,599,863 | 7/1986 | Marttila | 60/616 |
| 5,103,645 | 4/1992 | Haring | 123/68 |
| 5,311,739 | 5/1994 | Clark | 60/39.6 |

FOREIGN PATENT DOCUMENTS

| | | | |
|---|---|---|---|
| 474000 | 2/1915 | France | 60/616 |
| 2668543 | 4/1992 | France . | |
| 722524 | 1/1955 | United Kingdom . | |
| 1373820 | 11/1974 | United Kingdom . | |

OTHER PUBLICATIONS

WO 88/05223 Filed: Jul. 14, 1988 Abstract of Japanese Patent Application No. 61–207862.

21st Intersociety Energy Conversion Engineering Conference vol. 1 of 3, pp. 377–382, (1986).

*Primary Examiner*—Noah P. Kamen

[57] ABSTRACT

An internal combustion engine has a compression cylinder with a liquid spray apparatus for spraying sufficient liquid into the cylinder such that the liquid absorbs the heat of the gas as it is compressed without vaporizing. A separator removes the liquid from the gas/liquid mixture as it leaves the cylinder. The gas is then directed to a expansion cylinder for combustion with fuel delivered by a fuel supply apparatus. The cylinders being coupled together by a crankshaft.

22 Claims, 9 Drawing Sheets

HEAT ENGINE AND HEAT PUMP

This invention relates to heat engines and heat pumps, and in particular to those for providing power and/or heat appropriate to domestic appliances, service industries, commerce and manufacturing industry.

BACKGROUND OF THE INVENTION

The attainment of high thermal efficiency is nearly always an important consideration in the field of power generation for the reason that the fuel cost is generally responsible for about two thirds of the cost of the power produced. In addition to the cost incentive, enviromental considerations require that greater effort be directed towards the achievement of higher efficiencies in order to minimise the production of carbon dioxide and other undesirable emissions.

In general it is possible to achieve a higher thermal efficiency and fewer emissions in large generating units than in small ones. This is partly because of heat losses, friction and leakage flows which tend to be proportionally less significant in large units than in small ones. Also economies of scale make it possible to have more sophisticated equipment in large units. In small units, the cost of such equipment may be prohibitive.

In spite of these factors, there are circumstances where small generating units are needed and it is important that they should be as efficient and enviromentally benign as possible. This situation arises in the many parts of the world where no electricity grid is available. It may be that construction of a power station to supply electricity is beyond the financial capacity of the local population or it may be that the electricity demand is too small to justify its construction. The former situation arises in many less developed countries. The latter situation applies in many remote or thinly populated regions and on offshore islands.

Another application for small efficient engines arises in connection with combined heat and power (CHP). The use of heat and power together usually results in a higher overall energy efficiency than the use of mains power from the electricity grid. Since heat cannot be transported economically over any significant distance, CHP systems have to be sized for the local heat load. This usually implies generating units of modest size.

The invention described here can be applied either as a heat engine or in modified form as a heat pump. Heat pumps transfer heat from a low temperature heat source to a high temperature heat sink. For example, in cold weather a heat pump can extract heat from the atmospheric air and pump it to a higher temperature in order to heat a building. Alternatively, in hot weather, the heat pump can operate as an air conditioning unit to extract heat from the internal air of the building and reject it to the outside atmosphere, even though the outside temperature is higher than the inside temperature. The heat pump may also be used to cool air in order to condense the water vapour in it. The heat rejected from the heat pump may then be used to restore heat to the air. In this case the heat pump is used to de-humidify the air. As with CHP, heat pumps have to be sized in accordance with the local heat load. Consequently, most heat pump capacity will be required in the form of small rather than large units.

Most types of heat pump, air conditioning unit or refrigeration system require the use of an evaporating/condensing fluid which boils at an appropriate temperature such as one of the chloro-fluoro-carbons (CFC's). These substances are known to deplete the earth's ozone layer which protects human and animal life from harmful ultra-violet radiation. Although certain alternatives to CFC's are known, some of these also cause ozone depletion, but to a lesser degree. Other alternatives have disadvantages such as flammability, toxicity, high cost, poor thermodynamic properties or a tendency to increase global warming.

Engines and heat pumps based on the Stirling Cycle are well known. One form of Stirling engine includes a compression chamber and an expansion chamber connected together via a regenerative heat exchanger forming a gas space which contains a working gas. According to the ideal Stirling Cycle working gas in the compression chamber is compressed by a piston and undergoes isothermal compression, the heat of compression being rejected to a low temperature heat sink. After this process is complete the cold working gas is pushed through the regenerator where it is preheated before entering the expansion chamber. In the expansion chamber, the hot compressed working gas is allowed to expand by forcing the piston out of the expansion chamber. During expansion, heat is added to the working gas so that the gas expands isothermally. The hot expanded gas is then pushed back through the regenerator to which it gives up its heat before being admitted to the compression chamber to begin the next cycle.

U.S. Pat. No. 4,148,195 describes a heat actuated heat pump which requires a high temperature heat source such as the combustion of fuel and another heat source at low temperature such as atmospheric air. The heat output is at an intermediate temperature. The purpose of the heat pump is to convert a certain amount of heat energy at high temperature to a larger amount of heat energy at the intermediate temperature. This is done by extracting heat energy from the low temperature heat source. The heat actuated pump described in U.S. Pat. No. 4,148,195 is a closed-cycle system without valves which approximates to the Stirling cycle. Liquid pistons contained in a series of four interconnected U-tubes and which are connected in a closed circuit displace the working gas between adjacent expansion and compression chambers formed in the arms of the U-tubes. The liquid pistons transmit power around the closed circuit directly from the expanding gas in the expansion chamber to the compressing gas in the adjacent compression chamber, an expansion chamber and a compression chamber being formed in opposed arms of the same U-tube. The four U-tubes are connected via the gas space with regenerators. Two of the four regenerators and the associated gas volumes work in a temperature range between the high temperature and the intermediate temperature. The other two regenerators and associated gas volumes work in a temperature range between the low temperature and the intermediate temperature. The cycle is operated in such a way that power is transmitted via the medium of the liquid pistons from the gas volumes working over the high temperature range to the gas volumes working over the low temperature range.

21st Inter-society Energy Conversion Engineering Conference Volume 1 (1986) pages 377 to 382 describes a Stirling heat actuated heat pump similar to that described in U.S. Pat. No. 4,148,195, in which the working gas is heated or cooled by taking liquid from a liquid piston, heating or cooling the liquid externally and reinjecting it into the expansion or compression cylinder as an aerosol.

One drawback of these known heat pumps is that the maximum working temperature of the high temperature heat source is very low in comparison to what can be achieved in modern advanced power generating technologies, such as the combined cycle gas turbine. For example the temperature of heat addition to the heat pump is likely to be limited to 400° C., whereas the turbine inlet temperature of a modern power generating gas turbine is anything up to 1300° C. Consequently the efficiency of conversion of the high temperature heat to internal work within the heat actuated heat pump is also low, as would be expected from considerations of Carnot's theorem. As a result the overall coefficient of performance is very low.

Another disadvantage of the heat actuated heat pump described in U.S. Pat. No. 4,148,195 lies in the fact that the liquid pistons have to be very long in order to achieve a low natural frequency of oscillation. The frequency of oscillation must be low because sufficient time must be allowed for heat transfer between the droplet spray and the gas. The required length of liquid piston is particularly difficult to achieve in a small device operating at high pressure. Also friction losses arising from long liquid pistons are likely to become unnacceptably high in a small device. Furthermore a high value for the ratio of length to stroke is required to avoid the so-called shuttle loss which arises from the transfer of heat from one end of each liquid piston to the other end. The shuttle loss occurs because the two ends of each liquid piston are at different temperatures and there is consequently some mixing of the liquid and transport of heat.

U.S. Pat. No. 3,608,311 describes an engine whose operation is based on the Carnot Cycle, in which gas is successively compressed and expanded in a single cylinder by a liquid displacer. Hot and cold liquid from the liquid displacer is alternately injected into the cylinder to heat the gas during part of the expansion process, and to cool the gas during part of the compression process.

One drawback of this known heat engine is that the power output per cycle is relatively low because it requires an extremely high compression ratio to raise the temperature of the working gas to a reasonable value during adiabatic compression, and such a compression ratio is not possible in practice. A further drawback of this engine is that the working gas is continually cycled between high and low temperatures while remaining in the same cylinder throughout the process. Therefore the walls of the cylinder also cycle from low to high temperatures and back again which implies large entropy changes and a reduction in thermodynamic efficiency.

SUMMARY OF THE INVENTION

According to one aspect of the present invention there is provided a heat engine comprising a compression chamber to contain gas to be compressed and a first piston to compress said gas by movement of the piston in said compression chamber and driving means arranged to drive said first piston into the compression chamber to compress said gas, an expansion chamber and a second piston to allow gas to expand therein by movement of the second piston out of the expansion chamber, means to feed compressed gas from said compression chamber to said expansion chamber, and means to heat said compressed gas from the compression chamber, transmission means operatively coupled to said second piston to permit power from the engine to be drawn, and means forming a spray of liquid in said compression chamber to cool the gas on compression therein.

One advantage of this arrangement is that heat is rejected efficiently to the liquid in the liquid spray, at the lowest temperatures in the heat engine cycle. Furthermore, expansion is done in a separate chamber so that temperatures in each chamber and therefore the various parts of the chamber and of the pistons do not cycle between high and low temperatures, and thus reduceing the efficiency.

In a preferred embodiment, the engine further comprises means to add heat to the gas in the expansion chamber during expansion thereof. Thus, the expansion process may be approximately isothermal.

Preferably, the heating means also includes heat exchanger means arranged to pre-heat compressed gas from the compression chamber with heat from gas expanded in the expansion chamber. Thus, expanding the gas isothermally in the expansion chamber provides an opportunity of recovering some of this heat in a heat exchanger which is used to pre-heat the compressed gas from the compression chamber prior to expansion. The heat exchanger may for example be a regenerative heat exchanger if expanded gas from the expansion chamber flows along the same flow path as the incoming compressed gas from the compression chamber, or a recuperative heat exchanger if the gases flow along different flow paths. A recuperative heat exchanger is particularly advantageous where heat exchange is required between two gases where mixing of the gases is undesirable and/or the two gases are at substantially different pressures.

One embodiment includes means for returning expanded gas leaving the expansion chamber to the compression chamber for recompression. The returning means may be separate from the means for feeding compressed gas to the expansion chamber, or the working gas may flow back and forth between the compression and expansion chambers along the same flow path. Embodiments in which the same body of working gas is continuously recycled between the compression and expansion chambers will be referred to as a closed-cycle engine. Because the working gas is sealed within the engine, the gas can be pre-pressurised so that the minimum pressure attained by the gas during the cycle is much greater than atmospheric.

In one embodiment of the engine, the means to add heat to the gas in the expansion chamber comprises means forming a spray of hot liquid in the expansion chamber. The liquid used in the spray may be heated using an external heat exchanger and the source of heat may be waste heat e.g., industrial waste heat, solar energy or heat from a combustion chamber cooling system. Using a hot liquid spray to transfer heat into the expansion chamber is particularly advantageous when used in closed-cycle engines which have a heat source at relatively low temperature. Liquid sprays are not suitable for use at very high temperatures.

An alternative embodiment includes first valve means operative to admit air or other oxidising gas into the compression chamber, second valve means operative to prevent gas in the expansion chamber returning to the compression chamber through said means for feeding compressed gas to the expansion chamber and wherein the means to add heat comprises means to provide a combustible fuel in the expansion chamber. In this embodiment, the mixture of fuel and hot compressed gas in the expansion chamber ignites and after expansion the combustion products are expelled from the engine via the heat exchanger means. A fresh supply of working gas is therefore required at the beginning of each cycle. Embodiments in which the working gas is renewed each cycle will be referred to as an open-cycle engine. One form of this embodiment may include means to control the rate of flow of combustible fuel into the expansion chamber to provide substantially isothermal expansion.

It is generally preferable that the first and second pistons provide a good seal for the working gas and this is particularly important in the closed-cycle engine. Advantageously, the first and/or second pistons may comprise a liquid thus eliminating the sealing difficulties which may otherwise be present if the pistons are solid. A preferred embodiment comprises a pair of generally U-shaped conduits each containing a body of liquid as a piston, a compression chamber formed in each arm of one conduit and an expansion chamber formed in each arm of the other conduit, and means feeding compressed gas from one of said compression chambers to one of said expansion chambers and separate means feeding compressed gas from the other compression chamber to the other expansion chamber. In this embodiment, expansion and compression each occur twice per cycle and the timing of the liquid pistons is preferably arranged so that the expansion process in one of the expansion chambers drives the compression process in one of the compression chambers. This may be achieved by appropriate coupling between the drive means and the transmission means. A preferred embodiment comprises another pair of said generally U-shaped conduits whereby in use, the liquid piston in one U-shaped conduit containing expansion chambers is substantially 90° out of phase with the liquid piston in the corresponding U-shaped conduit containing the other expansion chambers. It will thus be appreciated that this arrangement can provide a net positive power output at each stage during a complete cycle of the engine, thereby removing the need for a fly wheel or other means to sustain the operation of the engine between power strokes.

When expanded gas is forced out of the expansion chamber by movement of the second piston into the expansion chamber, the gas pressure is increasing. A preferred embodiment of the engine includes means to provide liquids of at least two different temperatures for use in the liquid spray in the expansion chamber and includes means forming a spray of liquid during compression of gas in the expansion chamber to control the gas temperature. The temperature of the liquid spray is preferably such that the temperature of the gas remains constant during compression thereof. Advantageously, if said second piston comprises a liquid, said means to provide may be arranged to supply liquid from the liquid piston directly to the spray forming means.

After compression of gas in the compression chamber, the gas pressure decreases and the gas expands as a result of both pistons moving out of their respective chambers. A preferred embodiment includes means to provide liquids of at least two different temperatures in the liquid spray in the compression chamber and includes means forming a spray of liquid during expansion of gas in the compression chamber to control gas temperature. Preferably, the temperature of the liquid spray is such that the gas temperature is maintained constant during expansion. Advantageously, if said first piston comprises a liquid, said means to provide may be arranged to supply liquid from said first piston directly to the spray forming means.

Where any of the first pistons comprise a liquid, the drive means may comprise a member arranged to cooperate with the first piston such that motion of the member imparts motion in at least one direction to the piston. The member may comprise a solid piston and may be immersed in the liquid piston or floating on the surface thereof. The solid piston may be coupled to a shaft extending through the wall of the conduit containing the liquid piston.

Likewise, where the or one of the second pistons comprises liquid, the transmission means may comprise a member arranged to cooperate with said second piston such that motion of the liquid piston in at least one direction is imparted thereto. The member may comprise a solid piston which is immersed in the liquid piston or arranged to float on the surface thereof. A shaft may be coupled to the solid piston and extend through the wall of the conduit containing the second piston.

Alternatively, the first and second piston may comprise a solid material. One embodiment includes a pair of compression chambers and a pair of expansion chambers wherein in use the pistons in the compression chambers are arranged to move substantially in antiphase with each other and the pistons in the expansion chambers are arranged to move substantially in antiphase with each other. In a preferred embodiment, another said pair of compression chambers and another said pair of expansion chambers are provided wherein in use, the pistons in one pair of compression chambers are arranged to move substantially 90° out of phase with the pistons in said other pair of compression chambers and the pistons in one pair of expansion chambers are arranged to move substantially 90° out of phase with the pistons in the other said pair of expansion chambers.

Preferably, in a closed-cycle engine the heat exchanger means comprises a regenerator. The purpose of the regenerator is to enable heat to be transferred to and from the working gas efficiently.

In a preferred embodiment, separator means are provided to separate liquid from the gas leaving the or each compression chamber. In embodiments operating in a closed-cycle, a separator means may also be provided to separate liquid from the gas leaving the or each expansion chamber.

Where the first and/or second pistons comprise a liquid, means are preferably provided to supply the or each means forming a spray with liquid from the liquid pistons. Advantageously, said means to supply may include a pump arranged to be driven by a respective piston.

In one embodiment said driving means includes coupling means coupled to said transmission means so that in use, said first and second pistons move in predetermined phase relationship. It will be appreciated that coupling the first and second pistons together by for example a mechanical means such as a crankshaft is a convenient method to enable large compression ratios to be achieved, and at the same time maintain the phasing of the pistons. The phase angle between the first and second pistons may be such that the second piston leads the first piston by at least 90° Alternatively the pistons could be driven independently and may each be adapted together with any means for coupling to an external drive, to withstand substantial forces against the pressures in their respective chambers.

In one embodiment, the engine may further comprise a combustion chamber for the combustion of fuel, wherein the heating means comprises means to heat compressed gas from said compression chamber with heat conducted across at least one of the surfaces defining the combustion chamber of the engine. Thus, advantageously the present invention may readily be adapted to provide a cooling apparatus for a conventional combustion engine (e.g. petrol, diesel or gas) which recovers heat, normally wasted by conventional cooling apparatus and converts this heat into useful power. Cold compressed gas is produced in the compression chamber and heat lost to the combustion chamber walls is transferred to the compressed gas to provide cooling of the engine. The same method can be used to recover heat from the exhaust gases of a conventional combustion engine, for example by putting compressed air cooling channels through the exhaust manifold or by including a heat exchanger through which the exhaust gases would pass. The pre-heated compressed gas is then injected into the expansion chamber which expands forcing the piston out of the chamber and thereby generating useful mechanical work. In one embodiment, the expansion piston may be connected to an external output drive of the engine. This arrangement has the advantage of increasing the efficiency of conventional combustion engines.

According to another aspect of the present invention there is provided a heat pump comprising an expansion chamber to contain gas to be expanded and a first piston to allow the gas to expand by movement of the piston out of the expansion chamber, a compression chamber to contain gas to be compressed and a second piston to compress said gas by movement of said second piston in the compression chamber, means to feed gas from one of said expansion chamber and said compression chamber to the other chamber, and means to form a spray of liquid in said compression chamber to absorb heat from said gas during compression, wherein said second piston is adapted to be driven by an external source of power into said compression chamber to compress the gas.

This form of heat pump enables the pumped heat to be transferred to an external heat sink extremely efficiently via the medium of a liquid spray in the hot compression chamber and at the same time can be driven through, for example a mechanical coupling, by an external source of power and in particular an electric motor to provide a heat pump with a higher coefficient of performance than can be achieved by known heat pumps.

Advantageously, this form of heat pump can perform heating or cooling in either a closed-cycle or an open-cycle. For example, one embodiment may be adapted for air conditioning in which air is drawn into the compression chamber from an external source, compressed substantially isothermally using the liquid spray and passed to the expansion chamber in which it expands, so that it does work, returning some of the energy used for compression. The expansion may be adiabatic so that the gas cools, and the cool gas may then be ejected from the heat pump to provide air conditioning. Alternatively, another embodiment of the heat pump may further include means to supply heat to the gas during expansion thereof in the expansion chamber so that the expansion is approximately isothermal. This may be done efficiently by employing a liquid spray in the expansion chamber. Heat is absorbed from the liquid droplets, which cool, and the cooled spray liquid may be used for cooling, e.g., air conditioning. The liquid spray injection into the expansion chamber also allows efficient heat transfer from a low temperature heat source so that the heat pump can pump this heat to higher temperature sink, for the purpose of heating. The heat pump can be modified for either open or closed-cycles.

In another embodiment the heat pump may further comprise heat exchanger means arranged to pre-heat said expanded gas with heat from compressed gas leaving the compression chamber. This is particularly advantageous in the closed cycle in which the same gas is pumped back and forth between the expansion and compression chambers.

A preferred embodiment includes coupling means for coupling the second piston to the external source of power, wherein the coupling means is adapted to withstand substantial force against the pressure of gas in the compression chamber. Coupling the heat pump to an external source of power in this way, enables much higher pressures and therefore a higher compression ratio to be achieved in the compression chamber so that a greater amount of heat can be pumped per cycle than achieved by prior art heat pumps. At the same time, the use of such a coupling enables the heat pump to be compact, since the attainment of high pressures (and therefore output) does not rely on the inertia of the pistons which would have to be relatively massive and therefore large in size. The coupling means may for example comprise a crank shaft.

In a preferred embodiment, the first and second pistons are coupled together by a mechanical coupling means, e.g. a crank shaft so that the phasing of the pistons can be easily controlled.

Another important advantage of the heat pump according to the present invention is that it does not require an evaporating or condensing fluid, and can be used with a gas which does not condense and a liquid which does not evaporate to any significant degree. There is no requirement for a specific boiling point. Indeed, it is possible to choose a gas such as helium and a liquid such as water, which will cause no harm to the environment should they be released. This is also an important advantage of the heat pump according to the present invention. An additional advantage of not requiring a specific boiling point is that the heat pump can work over a wider range of operating temperatures than conventional heat pumps.

The heat pump may include any one or more of the preferred or alternative features mentioned above in association with the heat engine.

Embodiments of the heat engine and heat pump may include any number of compression and expansion chambers and the number of compression and expansion chambers need not be equal.

BRIEF DESCRIPTION OF THE DRAWINGS

Examples of embodiments of the present invention will now be described with reference to the drawings in which.

DETAILED DESCRIPTION OF THE INVENTION

Figure 1:
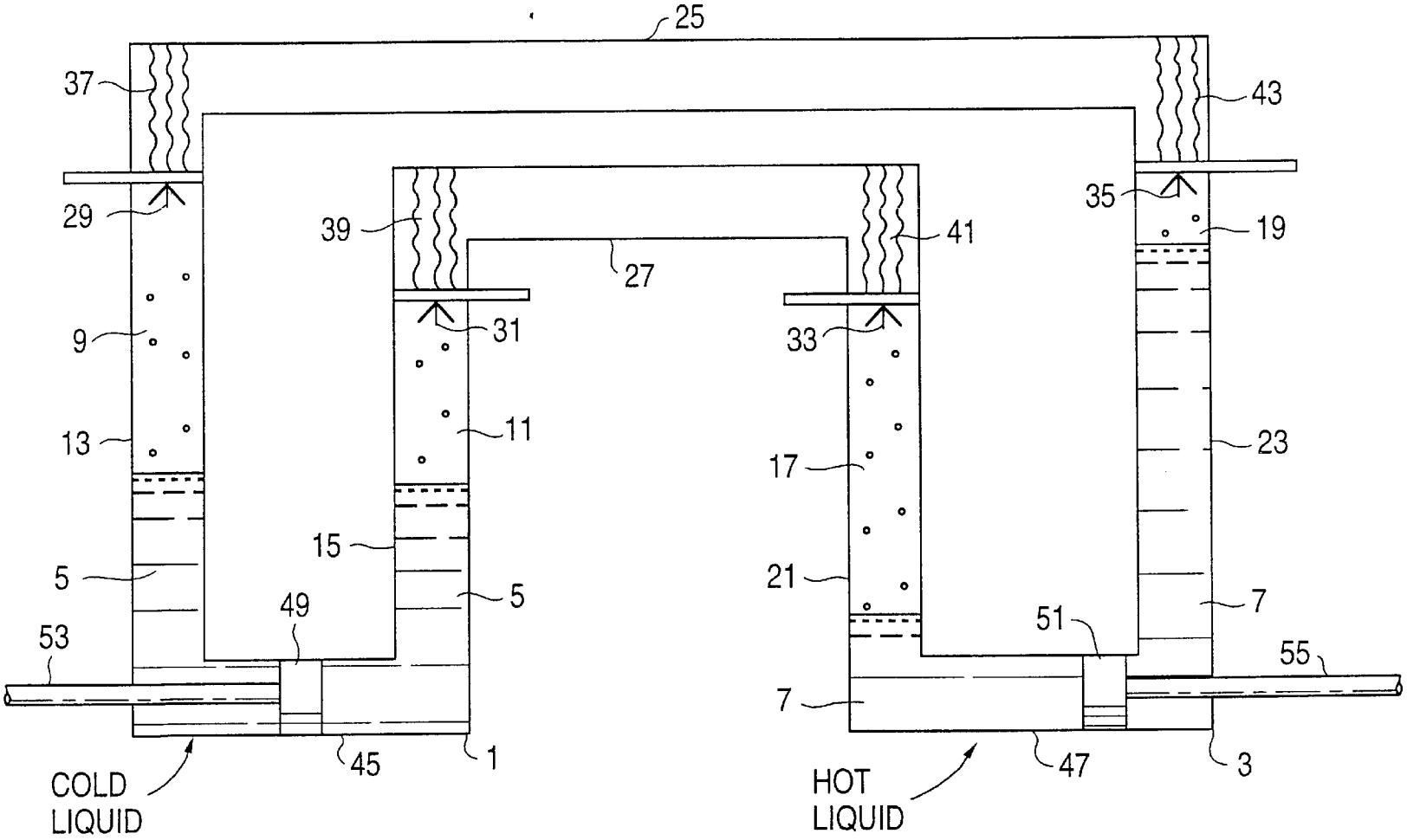
FIG. 1 shows a schematic diagram of a first embodiment of the present invention which includes liquid pistons and operates in a closed-cycle.
Figure 2:
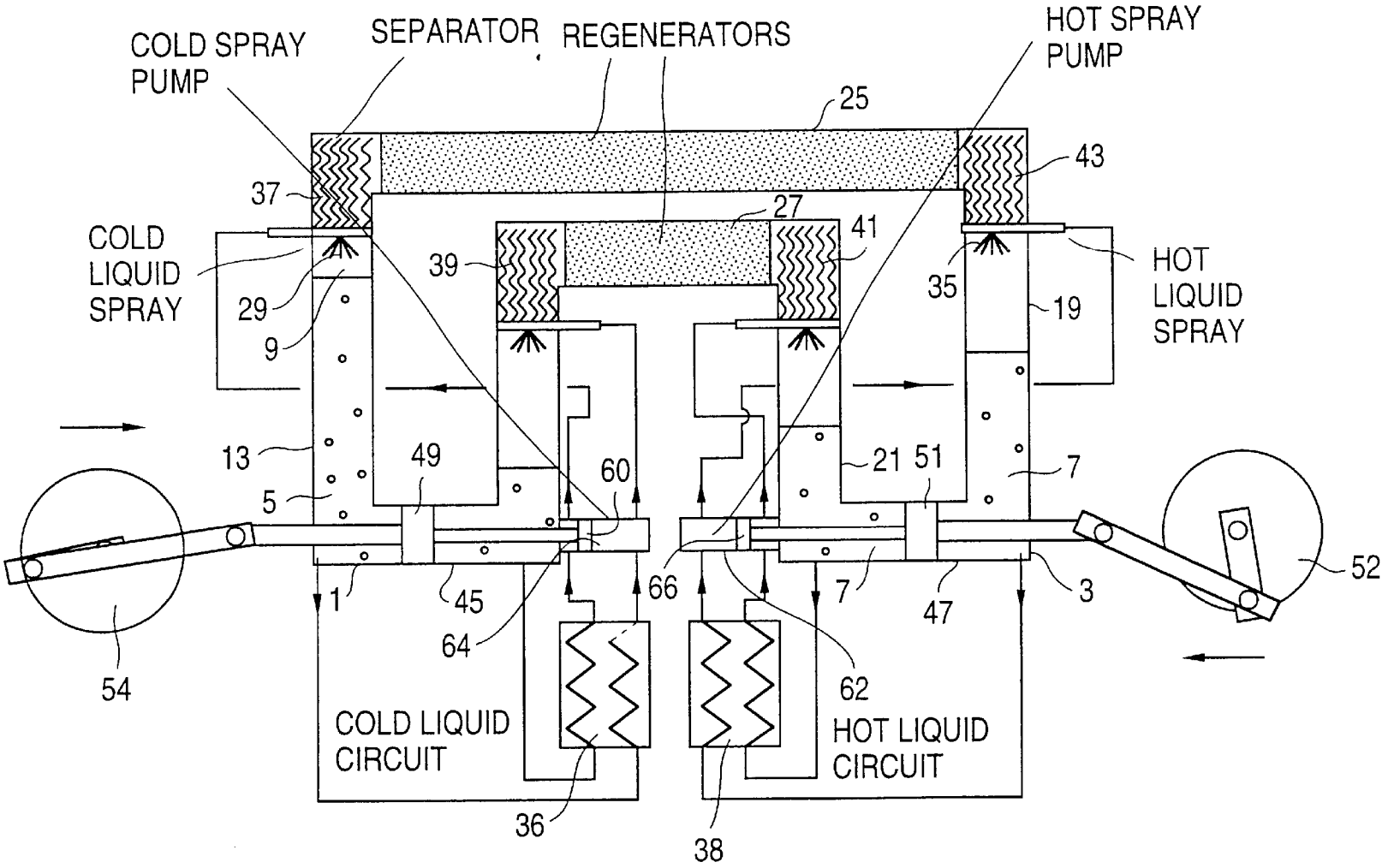
FIG. 2 shows a schematic diagram of a second embodiment of the invention.
Figure 3:
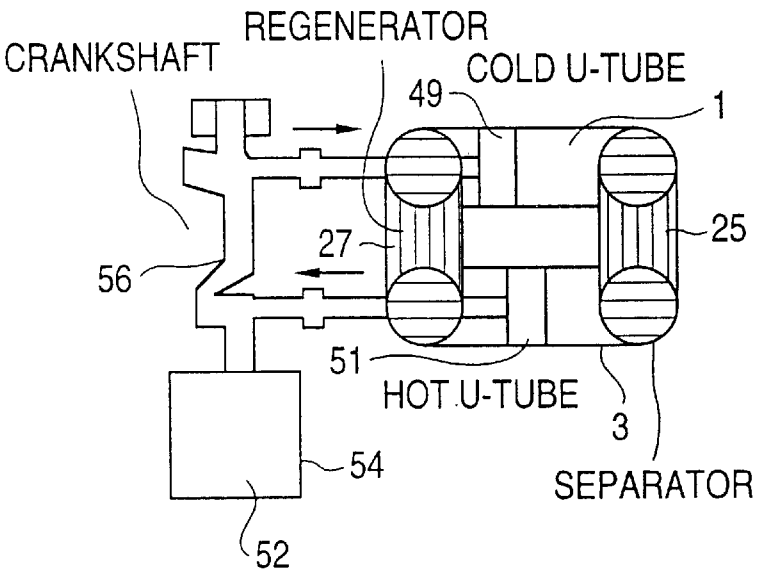
FIG. 3 shows a plan view of an embodiment of the invention.

Referring to FIGS. 1 to 3, a pair of U-shaped conduits 1 and 3 each contain a body of liquid 5 and 7. A compression chamber 9, 11 is formed in each of the arms 13 and 15 of one of the U-shaped conduits 1 and an expansion chamber 17, 19 is formed in each arm 21 and 23 of the other U-shaped conduit 3. One of the compression chambers 9 is connected through a regenerator 25 to one of the expansion chambers 19 and the other compression chamber 11 is connected through another regenerator 27 to the other expansion chamber 17. In practice, the U-shaped conduits shown in FIGS. 1 and 2 would each be rotated 90° to face each other, with the regenerators having the same length, as shown in FIG. 3.

The two U-shaped conduits and regenerators are thus configured as a saddle and will be referred to as "saddle loop". An engine or a heat pump which consists of a single inter-connected mass of gas with a single regenerator, a single compression chamber and a single expansion chamber, each with a liquid or solid piston and each with means for addition or removal of heat is described as a "half saddle loop".

Liquid sprays are provided in both compression chambers and both expansion chambers. Liquid used in the sprays 29 and 31 in the compression chambers is preferably drawn from the body of liquid in the conduit 1 and the liquid sprays 33 and 35 in the expansion chambers 17 and 19 is preferably drawn from the liquid in the corresponding conduit 3, as shown in FIG. 2. The liquid drawn from conduit 1 may be passed through a cooler 36 (FIG. 2) prior to injection in the compression chambers 9 and 11 and liquid drawn from conduit 3 may be passed through a heater prior to injection in the expansion chambers 17 and 19. A working gas fills the space formed by the compression chambers 9 and 11 and their corresponding expansion chambers 19 and 17 with which they communicate via a respective regenerator 25 and 27. Separators 37, 39, 41 and 43 are provided between the chambers and corresponding regenerators to remove any liquid in the working gas before the fluid passes through the regenerator concerned.

Each U-shaped conduit 1 and 3 has a linear section 45 and 47 joining the adjacent arms. Mechanical means coupled to each liquid piston is provided to transmit power to and from the pistons. In the embodiment shown in FIGS. 1 to 3, a solid piston 49 and 51 is disposed in each of the linear sections of the conduit and is free to execute linear motion along the length thereof with the liquid pistons formed either side. A drive shaft 53, 55 is connected to each solid piston 49 and 51 and extends through the wall of each conduit to provide means for driving or transmitting power from the liquid pistons.

The two drive shafts 53 and 55 are coupled together by an external drive mechanism so that the displacement of each piston is approximately sinusoidal with time and so that a predetermined phase relationship is maintained between the pistons in different conduits. This can be achieved for example by coupling the drive shafts 53 and 55 to a crankshaft as for petrol or diesel engines, as shown in FIGS. 2 and 3. The crankshaft may be coupled to drive an electricity generator 52.

The engine operates by passing the working gas through a thermodynamic cycle which involves repeated compressions and expansions. The compression is done when most of the working gas is in the compression chamber 9 and 11 while the expansion is done when most of the working gas is in the expansion chamber 17 and 19. This may be achieved by arranging for the pistons in the expansion chambers to lead the pistons in the compression chambers by a phase angle of 90° The phase angle between the pistons in the expansion chambers or compression chambers is 180° With this arrangement, the expansion process in one of the expansion chambers will drive the compression process in the other compression chamber. For example expansion in chamber 19 will drive the compression in chamber 11 and the expansion in chamber 17 will drive the compression in chamber 9.

One complete cycle of the engine will now be described in relation to one compression chamber and one expansion chamber only, beginning with compression in compression chamber 9. At the start of compression the liquid piston in the compression chamber 9 is at the bottom of its stroke and the piston in the expansion chamber 19 is at the mid-point of its stroke and moving upwards. Most of the working gas shared between the compression chamber 9 and the expansion chamber 19 is in the compression chamber 9. The compression piston moves into the compression chamber 9 and compresses the working gas against the gas pressure resulting from movement of the expansion piston into the expansion chamber 19. Cold liquid is sprayed into the compression chamber to cool the working gas during compression. This liquid may be obtained by drawing off liquid from the cold liquid piston (i.e. the compression piston) and then passing it through an external cooler 36 (shown in FIG. 2) before injecting it into the compression chamber. When the compression piston in compression chamber 9 is at the mid-point of its stroke the expansion piston in expansion chamber 19 will be at the top of its stroke and about to reverse direction. As the compression piston continues moving upwards in the compression chamber, compression of the working gas continues but at the same time the cool compressed gas begins to flow through the regenerator towards the expansion chamber 19 as the expansion piston begins to move downwards. The cool compressed gas leaving the compression chamber 9 is pre-heated with heat from the expanded gas which left the expansion chamber at the end of the previous cycle.

When the compression piston in compression chamber 9 has reached the top of its stroke, the expansion piston in expansion chamber 19 is at the mid-point of its stroke and moving downward, out of the expansion chamber. Hot liquid is sprayed into the expansion chamber to maintain the temperature of the gas as it expands on continued downward movement of the expansion piston. This liquid may be obtained by drawing off liquid from the hot liquid piston (i.e. the expansion piston) and then passing it through an external heater 38 (FIG. 2) before injecting it into the expansion chamber. At the same time, the compression piston has reversed direction and is moving out of the compression chamber 9. To prevent the gas in the compression chamber from cooling during expansion it may be advantageous to spray liquid drawn directly from the liquid piston rather than liquid which has been pre-cooled in an external cooler.

When the expansion piston has reached the bottom of its stroke in the expansion chamber 19 the compression piston will be at the mid-point of its stroke in the compression chamber 9 and moving downwards. The expansion piston reverses direction and the two pistons move in opposite directions forcing the working gas out of the expansion chamber, through the regenerator and into the compression chamber. The hot expanded gas leaving the expansion chamber is pre-cooled in the regenerator before returning to the compression chamber. As the expansion piston moves upwards into the expansion chamber, the gas remaining in that chamber undergoes some compression. To prevent heating of the gas, liquid may be sprayed into the expansion chamber. This liquid should preferably be taken directly from the hot liquid piston without passing through the external heater. When the compression piston in the compression chamber 9 reaches the bottom of its stroke, the expansion piston in the expansion chamber 19 is at the mid-point of its stroke and travelling upwards into the expansion chamber, the compression piston reverses direction and the cycle is repeated.

Figure 4:
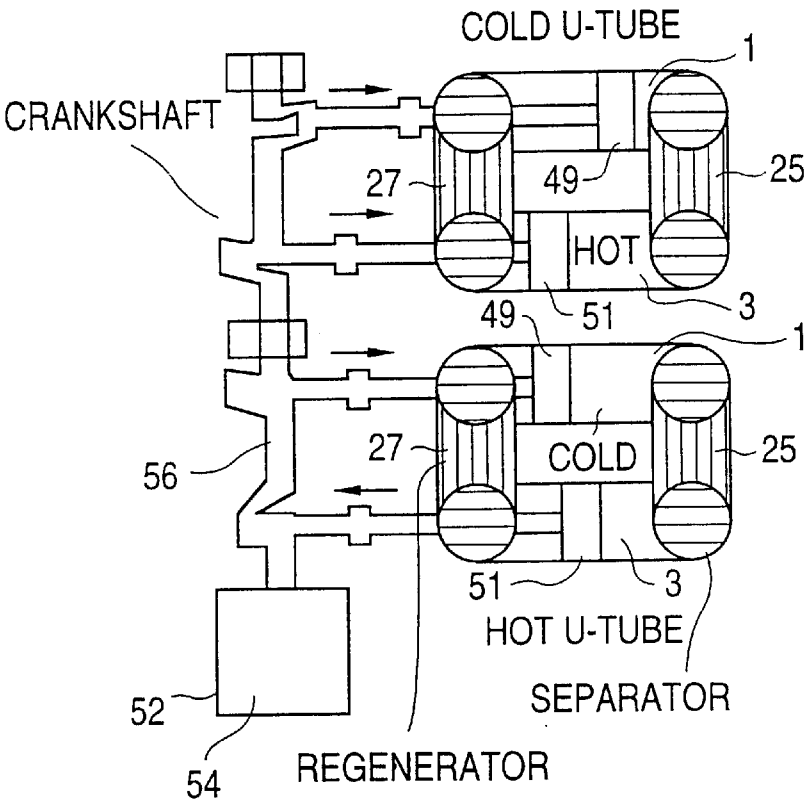
FIG. 4 shows a plan view of another embodiment of the invention.

As mentioned above, the thermodynamic cycle in chambers 9 and 19 is 180° out of phase with the cycle in chambers 11 and 17. Thus, the expansion stroke in chamber 19 drives the compression stroke in chamber 11 and the expansion stroke in chamber 17 drives the compression stroke in chamber 9. However, there are points in the cycle between the compression and expansion strokes where no net power output from the engine is occuring. Thus, to sustain the operation of the engine over the cycle a fly wheel may be used or it may be possible to rely on the inertia of the pistons themselves if they are massive enough. However, the need for a fly wheel can be avoided by providing a second saddle loop whose operating cycle is arranged to be 90° out of phase with that of the first saddle loop. This may be achieved by incorporating an appropriate external drive mechanism. This embodiment of the heat engine is then capable of providing a net energy output at all stages of the cycle. An example of such an embodiment with an appropriate external drive mechanism 58 is shown in FIG. 4, in which similar parts to those shown in FIGS. 1 to 3 are designated by like numerals.

One of the most important features of the engine described above is the use of hot and cold liquid sprays to maintain the temperature of the working gas within each chamber at the desired value. As stated above, the liquid sprays may be maintained throughout the cycle, although the liquid passes through the heat exchangers during only part of the injection cycle. The reason for this can be explained in connection with each chamber separately.

During compression, the function of the spray is to keep the working gas temperature in the compression chamber as low as possible. Thus the liquid should be passed through the external cooler during this part of the cycle. When the gas is expanded, in a later part of the cycle, the function of the spray is to prevent the gas from cooling too much. During this part of the cycle, it is better to take the liquid directly from the liquid piston and not to cool it.

The converse argument applies to the expansion chamber. During expansion the gas must be as hot as possible and therefore the liquid spray should be passed through the external heater. During compression, it is important to prevent the gas from becoming too hot. Therefore, the liquid should be taken directly from the liquid piston during this stage.

In one embodiment, the pumping of the liquid used for the spray may be achieved by making direct use of the reciprocating motion of the piston and drive shaft. The pump which may be mounted within the conduit comprises a small piston driven by the liquid piston, the solid piston or the drive shaft, for example, as shown in FIG. 2, and which is arranged to slide in a cylinder incorporating non-return valves. A single pump 60,62 in each conduit may be provided if the pump is double ended i.e. fills and pumps at both ends. This enables liquid to be supplied from each end alternately while the other end is filling. One double ended pump would serve two liquid spray injectors associated with that particular conduit. Each end of the pump may have two outlets, one which leads to the spray nozzle in one of the chambers associated with the particular conduit, while the other leads directly to the spray nozzle in the other chamber. Thus, although a liquid spray would be maintained almost continuously, the temperature of the injected liquid would vary during the cycle according to whether it had passed through the heat exchanger or not.

The separators situated above the spray injector nozzles and which may comprise corrugated plates, also play an important part in the heat transfer process between the liquid spray and working gas, since the corrugated surfaces are expected to be cooled or heated by contact with the liquid from the spray, and will extend the contact area between the working gas and the liquid. When the gas flow in a particular chamber is upward, then most of the droplets injected at that time will be carried upwards into the separator. However there will still be many droplets in the lower gas space, resulting from the injection at earlier times. When the gas flow is downward, most of the liquid that has been separated onto the corrugated plates will be swept downwards into the chamber. In this way, it is expected that the separators will repeatedly collect then discard the liquid carried over into them. The separators may in addition, or alternatively be arranged to cause the working gas to swirl to facilitate the removal of liquid droplets, while at the same time minimising the pressure loss of the gas flow.

The purpose of the regenerators is to change the temperature of the working gas from hot to cold or vice versa in a thermodynamically efficient way. The regenerator may comprise an array of narrow channels of various cross sectional geometries designed to provide a large heat transfer area between the gas and the material of the regenerator. The narrow channels may be formed using for example plates or tubes. The regenerator stores the heat from the working gas until the working gas reverses its direction of flow, after which the heat is restored to the working gas. The regenerator should also be designed to minimise the pressure drop over its length.

The choice of working gas and heat transfer liquid in the liquid pistons depends on the application and the temperature range over which the engine needs to work. Because the engine operates in a closed-cycle and the liquid pistons form a perfect seal, the choice of working gas is not necessarily restricted by availability or cost and may be chosen for its thermodynamic properties. Thus, the working gas may be for example helium or hydrogen, which have excellent heat transfer characteristics. Helium may be preferred to hydrogen on safety grounds, although it would be more expensive. Another advantage of the closed-cycle engine is that the operating pressures of the working gas can be relatively high and would generally be in the range of 1–20 MPa (10–200 bar).

At operating temperatures up to about 200° C., water may be used as the heat transfer liquid. However, at higher temperatures water would probably not be suitable because of the high pressures needed to maintain it in the liquid state. For operating temperatures up to about 400° C., commercial heat transfer fluids which are also liquid at low temperatures may be used. It is likely that helium would again be selected as the working gas for this higher temperature range. For operating temperatures above 400° C. a liquid metal such as the sodium-potassium eutectic mixture (NaK) may be used with helium as the working gas. Eutectic NaK remains liquid down to −12° C. and boils at 785° C. (at atmospheric pressure). Molten salts are possible high temperature alternatives to liquid metals. However, because of the likely engineering difficulties in designing an engine suitable for use with high temperature liquids at temperatures above 400° C., it may be better not to use a hot liquid at all. Instead, heat may be transferred into the engine through the walls of a heat exchanger enabling the engine to be driven from much higher temperature heat sources including the combustion of fuel. This fuel could be heavy oil, coal, biomass or domestic waste, since the products of combustion do not enter the engine. Thus, embodiments of the heat engine which employ hot liquid injection, are very suitable for power generation from relatively low temperature heat sources such as industrial waste heat or solar energy.

The closed-cycle heat engine can be modified to operate as a heat pump in which mechanical energy is used to pump heat from a low temperature source to a high temperature sink. Thus, in contrast to the heat engine, compression is done on the working gas when the gas is hot and expansion is done when the working gas is cold. One embodiment of the heat pump may be described with reference to FIG. 1 or 2. In these embodiments, mechanical energy to drive the heat pump is imparted to the solid pistons 49 and 51 via drive shafts 53 and 55. In contrast to the heat engine, the liquid piston in the compression chamber leads the piston in the associated expansion chamber by a predetermined phase angle, e.g. 90° instead of vice versa. Referring to FIGS. 1 and 2, liquid sprays 29 and 31 in chambers 9 and 11 are used to transfer heat to the heat pump from a low temperature heat source. Cool liquid is injected into chambers 9 and 11 during expansion of the working gas in the chambers which is driven by the liquid pistons. During expansion, heat from the spray is transferred to the working gas and the expansion process may be approximately isothermal. After heat has been extracted from the droplets in the liquid spray, the now cooler droplets recombine with the liquid in the liquid piston whose temperature will decrease as a result. Cool liquid from the liquid piston is passed to a suitable heat exchanger 38 (FIG. 2) in which heat is transferred to the liquid from a heat source. The heat source for the cold liquid could be atmospheric air, the ground, a river, stream or other body of water. Another possibility is to use extracted stale air from a ventilation system as the heat source. Alternatively warm waste water from baths etc. may be used. This is the converse of the operation of the heat exchanger in the heat engine in which the heat exchanger transfers heat from the liquid to a low temperature heat sink.

Liquid sprays 33 and 35 in chambers 17 and 19 spray hot liquid into the chambers during compression of the working gas which is driven by the liquid piston. The hot liquid spray serves as a heat sink to the working gas, absorbing the heat produced by the work of compression. After compression, the now hotter liquid droplets in the spray recombine with the liquid piston whose temperature is thereby increased. Hot liquid from the liquid piston is passed to a suitable heat exchanger (not shown) in which heat from the liquid is transferred to the point of use. This is the converse of the operation of the heat exchanger in the heat engine in which the heat exchanger transfers heat from a hot source to the liquid. The heat may, for example be supplied to a hot water system similar to those used in many households. Alternatively the heat may be supplied to a ducted air system.

A cycle of the heat pump in relation to one of the cold chambers 9 and the associated hot chamber 19 proceeds as follows, beginning with the liquid piston in the hot chamber 19 at the top of its stroke and reversing direction.

As the liquid piston reaches the top of its stroke in the hot chamber 19, the liquid piston in the cold chamber 9 is reaching the mid-point of its stroke and moving out of the cold chamber 9. On continued movement of the liquid piston out of chamber 9, the cool gas expands and at the same time, cool liquid is injected into the cold chamber via the spray 29. The working gas in chamber 9 absorbs heat from the liquid spray and the gas expands approximately isothermally. When the liquid piston in cold chamber 9 reaches the bottom of its stroke and reverses direction, the liquid piston in hot chamber 19 reaches the mid-point of its stroke and is moving out of the chamber. As the liquid piston in chamber 9 moves into the chamber, cool working gas is forced out of the chamber, passes through the regenerator in which it is preheated with heat from the working gas which left the hot chamber at the end of the previous cycle, and enters the hot chamber 19. When the liquid piston in chamber 19 reaches the bottom of its stroke and reverses direction, hot liquid is sprayed into chamber 19 via spray nozzle 35. At this point the liquid piston in chamber 9 reaches the mid-point of its stroke and most of the working gas is in the hot chamber 19. The liquid piston in chamber 19 moves upwards into the chamber and compresses the working gas. The heat of compression is transferred to the liquid droplets in the hot spray and the compression process may be approximately isothermal. As the liquid piston in chamber 19 reaches the mid-point of its stroke, the liquid piston in the cold chamber 9 reaches the top of its stroke and reverses direction. On continued movement of the liquid piston into chamber 19 the working gas is forced out of the chamber and through the regenerator 25 to which it gives up its heat. The cool gas leaving the regenerator returns to the cold chamber where the cycle begins again.

When the piston in the cold chamber 9 is moving into the chamber and forcing gas out, the gas pressure increases, tending to increase the gas temperature. Liquid may be sprayed into the cold chamber as the gas is being compressed to prevent the gas from heating too much and preferably to maintain the gas temperature constant. If a liquid piston is used, liquid for the spray may advantageously be drawn directly from the liquid piston. Similarly, when the piston in the hot chamber is moving out of the chamber and drawing gas in, the gas pressure drops, tending to lower the gas temperature. To prevent this, liquid may be sprayed into the hot chamber as the gas expands, so as to maintain the gas temperature constant. If a liquid piston is used, liquid for the spray may advantageously be drawn directly from the liquid piston.

As for the heat engine, two saddle loops may be used and these will be 90° out of phase with each other, as shown in the embodiment of FIG. 4. Preferably, the working gas is a gas which does not pass through a phase transition (i.e. condense or evaporate) within the range of operating temperatures and pressures used in the heat pump. The working gas may, for example, be helium or hydrogen as for the heat engine. The heat transfer liquid may be water, and depending on the temperature of the cold source, anti-freeze may have to be added. If air is used as the heat source, then the heat source heat exchanger may have to be regularly de-frosted.

The heat pump may be used for example for domestic or commercial applications for air-conditioning, refrigeration, space heating or for heating water. The heat pump may be driven by an electric motor 52 as shown in FIGS. 2 to 4. The efficiency of a heat pump is usually expressed as the co-efficient of performance, or COP, which is the conversion ratio of electricity to heat. The COP also depends on the temperatures of the heat source and the required heat supply. For heating of water for space heating and other domestic purposes, a conventional heat pump might be able to achieve a COP of about 3. The heat pump cycle described above, is expected to achieve COP's of about 3.5 in a domestic application when the heat source is just above freezing temperatures. The achievable COP should be about 4 with the heat source temperatures increased by the use of solar panels or by heat recovery from domestic waste water. Alternatively a heat pump as described above could extract heat from the atmosphere at near freezing point to provide ducted warm air for space heating at a COP of about 4. The COP could be improved above 4 if some heat was recovered from waste water, from stale ventilation air or from solar warming.

Returning to the heat engine, another embodiment relies on the combustion of fuel to add heat to the working gas. A combustible fuel is injected into the expansion chamber, mixes with the hot compressed gas and ignites. The fuel is preferably a clean fuel such as gas or light distillate oil. An embodiment of this version of the heat engine is shown schematically in FIG. 2. Many of the features in the embodiment shown in FIG. 2 are similar to those of the embodiment shown in FIGS. 1 and 2 and like features are represented by like numerals.

Figure 5:
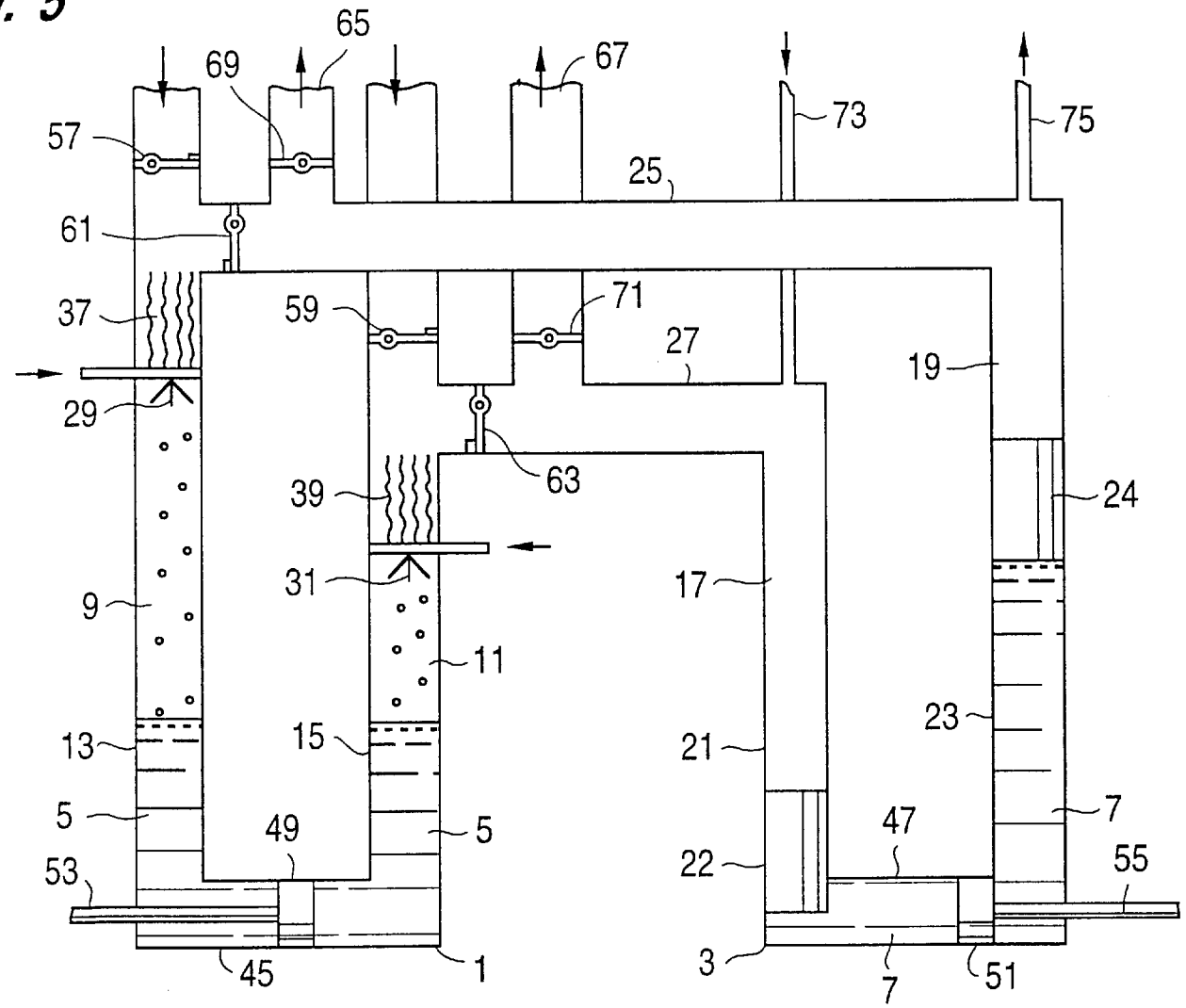
FIG. 5 shows a schematic diagram of a another embodiment of the present invention including liquid pistons and which operates in an open-cycle.

Referring to FIG. 5, the heat engine comprises a pair of U-shaped conduits 1 and 3 each partially filled with liquid each of which serves as a liquid piston. Compression chambers 9 and 11 are formed in the arms 13 and 15 of one of the conduits 1 and combustion chambers 17 and 19 are formed in the arms 21 and 23 of the other conduit 3. One of the compression chambers 11 is arranged to communicate with one of the combustion chambers 17 through a heat exchanger which is preferably a regenerator 27 and the other compression chamber 9 is arranged to communicate with the other combustion chamber 19 through another heat exchanger 25 which may also be a regenerator. The compression chambers 9 and 11 are provided with gas inlet valves, to admit air or other oxidising gas into the chambers and these may, for example be non-return valves. Each compression chamber 9 and 11 has a liquid spray injector 29 and 31, the liquid used in the spray being drawn from the liquid piston, as before. Another valve 61, 63 is positioned between the compression chamber 9, 11 and the regenerator 25, 27 to prevent exhaust gases from the combustion chamber 19, 17 via the regenerator 25, 27 returning to the compression chamber 9, 11. An exhaust port 65, 67 operated by an exhaust valve 69, 71, is provided between valve 61, 63 and the regenerator 25, 27 to enable exhaust gases to be expelled after passing through and giving up their heat to the regenerator 25, 27. A fuel inlet port 73, 75 is provided in each combustion chamber 17, 19 to enable fuel to be introduced into the chamber. Each exhaust valve 69, 71 is operated by a suitable timing mechanism (not shown).

The engine cycle in relation to one of the compression chambers and the associated combustion chamber is as follows. When the level of liquid in the compression chamber 9 falls to the point at which the internal pressure becomes less than the pressure on the other side of the non-return valve 57, the inlet valve 57 opens and oxidizing gas is drawn in. If the gas source is atmospheric air, then the inlet valve will open when the pressure in the compression chamber is less than atmospheric. As the piston in the compression chamber reaches and falls beyond the mid-point of its stroke, the piston in the combustion chamber 19 reaches the bottom of its stroke and reverses direction. The exhaust valve 69 is opened and as the combustion piston moves into the combustion chamber, the exhaust gases are forced through the regenerator giving up their heat in the process. The non-return valve 61 prevents the exhaust gases from entering the compression chamber 9.

When the combustion piston reaches and goes beyond the mid-point of its stroke in the combustion chamber, the compression piston reaches the bottom of its stroke and reverses direction. When the compression piston reaches its lower limit and starts to move upwards, the inlet valve closes so that the oxidising gas that was drawn in becomes compressed. The liquid spray maintains the gas close to ambient temperature, thus providing an approximately isothermal compression. During compression when the compression piston is between its lower limit and the mid-point of its stroke, the expansion piston continues to move into the expansion chamber 19 forcing the hot combustion gases through the exhaust port 65 via the regenerator 25. When the pressure in the compression chamber exceeds that of the combustion chamber, the non-return valve 61 connecting the chambers opens and cool compressed gas passes through the regenerator, extracting heat so that it enters the combustion chamber at high temperature. The combustion piston reverses direction and moves out of the combustion chamber while the compression piston approaches the top of its stroke in the compression chamber. Shortly before the liquid piston reaches the top of its stroke in the compression chamber, and shortly before the combustion piston in the combustion chamber reaches the mid-point of its stroke, fuel is injected into the combustion chamber 19 and ignites either spontaneously or with the help of a pilot flame or spark (not shown). At some point during the continued downward movement of the combustion piston out of the combustion chamber, the fuel is turned off. The rate of injection of fuel may be regulated to provide approximately isothermal expansion. The compression piston will have reversed direction drawing a fresh supply of gas into the chamber and as the combustion piston approaches the bottom of its stroke the exhaust valve 65 opens and the cycle is repeated.

To avoid the need for a fly wheel, two saddle loops may be provided which are arranged to operate 90° out of phase from each other, as, for example, shown in FIG. 4. A mechanical drive system would be used as for the closed-cycle engine. The liquid forming the liquid piston in the conduits containing the combustion chambers and the compression chambers may be oil, water or possibly another fluid. The liquids in the two conduits are not necessarily the same. Floats 22, 24 comprising a solid material which float on the surface of the liquid piston in each combustion chamber may be provided to limit the contact of the combustion gases with the liquid. Some means of cooling the combustion chamber walls may also be provided.

Both the closed-cycle engine and the open-cycle engine described above produce a work output involving large reciprocating forces at low frequency, for example about 1 Hz. If the engines are to be used in electrical power generation, a means would generally have to be provided to convert the slow speed form of mechanical energy into a suitable form to drive an electric generator. For modest unit sizes with a generating capacity up to about 1 MW, a slow speed crank shaft could be used, connected to a generator by appropriate gearing. Alternatively, a hypo-cyclic gear mechanism or worm drive gearing may be used. In the case of hypo-cyclic gears, the drive shaft of the engine is connected to a planet wheel having gear teeth around its external circumference. The planet wheel rolls around the inside of a fixed wheel having gear teeth on its internal circumference. The planet wheel is mounted on an arm which rotates as the planet wheel rolls around the inside of the fixed wheel. The rotating arm drives a generator via a speed-up gearing. This achieves the same kind of motion as crankshaft, but with the advantage that large side thrusts otherwise produced by a crankshaft, are avoided. It is also possible to make the hypo-cyclic gear more compact than a conventional crankshaft. Alternatively, the engine could be adapted to pump a hydraulic fluid through a turbine connected to a generator. This technique would be suitable for both large and small unit sizes.

Figure 6:
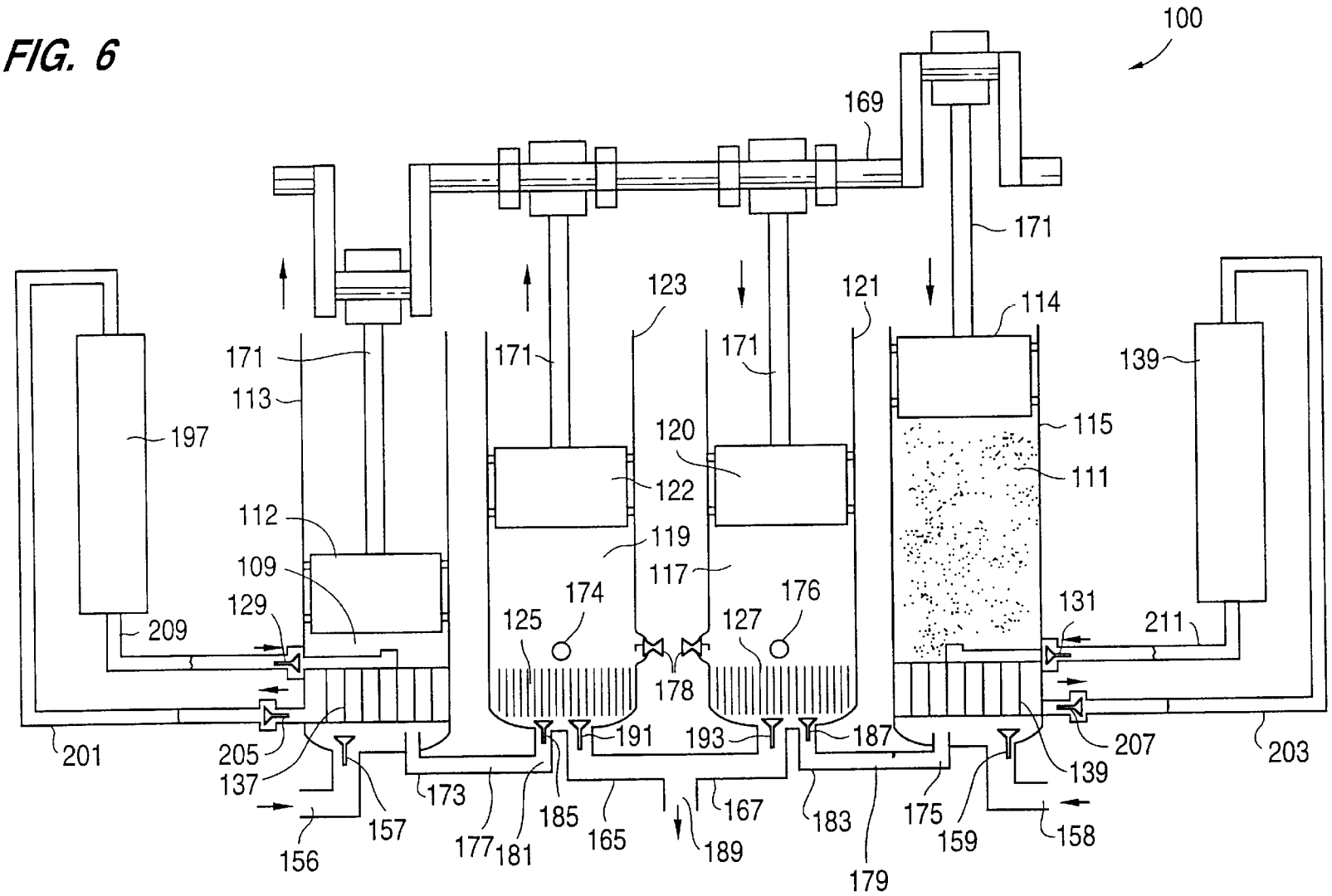
FIG. 6 shows a schematic diagram of a another embodiment of the present invention including solid pistons and which operates in an open-cycle.

In another embodiment the liquid pistons may be replaced by solid pistons. Although it is possible to use solid pistons in the closed-cycle engine in which the working gas is passed back and forth between the expansion and compression chambers, it may be difficult to achieve adequate sealing of the enclosed high pressure gas, which is likely to be helium or hydrogen. Sealing is less critical for the open cycle engine in which a fresh supply of air or other oxidising gas is used at every cycle and consequently the use of solid pistons might be more appropriate for this case. FIG. 6 shows one embodiment of this form of heat engine.

Referring to FIG. 6, an embodiment of the engine is generally indicated at 100, and comprises four cylinders 113, 115, 121 and 123. A piston is provided for each cylinder and each piston is connected to a crankshaft 169 by a connecting rod 171. In this embodiment, the engine is oriented such that the crankshaft is above the cylinders. Compression chambers 109 and 111 are formed in two of the cylinders 113 and 115 and expansion chambers 117 and 119 are formed in the other cylinders 121 and 123. Each compression chamber has a gas inlet port 156, 158 controlled by gas inlet valves 157, 159 and a compressed gas outlet port 173, 175. A gas feed line 177, 179 connects a compression chamber 109, 111 with a respective expansion chamber 119, 117 via a compressed gas inlet port 181, 183, each controlled by a gas inlet valve 185, 187 in the expansion chamber 119, 117. Each expansion chamber 117, 119 has an exhaust gas outlet port 167, 165 controlled by an exhaust valve 193, 191. All the gas inlet and outlet ports are situated near the bottom of the expansion and compression chambers.

A spray nozzle 129, 131 is provided in each compression chamber 109, 111 for injecting a liquid spray into each chamber 109, 111 during compression. A separator 137, 139 is mounted within each compression chamber 109, 111 to remove liquid from the compressed gas before the gas leaves the compression chamber. Thus the separator 137, 139 is situated above the compressed gas outlet port 173, 175. Various kinds of separator may be used, but it is important for the separator to be as compact as possible without causing too great a pressure drop in the gas entering the chamber or the compressed gas leaving the chamber. To avoid the separator causing a pressure drop in the flow of inlet gas, the gas inlet port may be situated on the piston side of the separator. To achieve small pressure loss, the separator may comprise a number of small swirl vanes mounted in short pipe sections with the pipe sections mounted in parallel. The induced swirl of gas causes entrained droplets to be thrown outwards and collected at the pipe walls. Swirl vane separators are often used for example in the steam generators and steam to steam reheaters of pressurised water reactors.

Each separator 137, 139 is connected to an external cooler 197, 199 by a duct 201, 203. The flow of liquid from the separator to the cooler is controlled by valves 205 and 207, which may be non-return valves. Cooled liquid from the cooler is returned to a compression chamber via a duct 209, 211 and a valve 129, 131 which may be of the non-return type. The flow of liquid around this circuit may be driven by the cyclic pressure variation in the compression chamber, which forces the liquid through the non-return valves in the required direction. It is necessary to maintain a gas space above the liquid level within the cooler to allow this process to occur. This could be done by the use of a level controller, such as a ball valve, mounted in the cooler. A separate supply of liquid may be connected to the cooler to replace any liquid which is lost in the gas flow to the combustion chamber. The replacement of liquid may also be controlled by the level controller, if this is used.

The separator and cooling circuit described above provides for the separation, re-circulation and pumping of cooled liquid as a fine spray into the compression chamber without the use of external pumps. A similar arrangement may also be implemented in heat engines having liquid pistons. For some applications, it may be appropriate not to use a non-return valve upstream of the spray injector, but to control the injection using for example, a cam which would allow better control of the timing of the spray. Preferably, the timing is optimised to take account of the pressure difference between the cooler and the compression chamber and the finite transit time of the droplets within the chamber. Alternatively, internal or external pumps may be used to drive the flow of liquid through the spray injectors. In this case the pumps are preferably mechanically coupled to the piston shafts so that a separate power source is not needed. Spray pumps are more likely to be appropriate for use with engines or heat pumps in which there is a liquid piston, because of the slower operating speed. In these cases, the transit time of the droplets may be rather short in comparison with the time to complete one cycle of the engine.

Each expansion chamber 119, 117 has a regenerative heat exchanger 125, 127 mounted so that gas passes through the heat exchanger before entering or leaving the expansion chamber via the inlet and outlet ports respectively. Each expansion chamber has a fuel injection valve 174, 176 controlled by a suitable timing mechanism and a spark plug 178 to ignite the fuel/gas mixture which may be used for starting the engine or for both starting and continuously during running.

The regenerative heat exchanger may consist of a large number of parallel channels of small diameter and short length cast for example in a honeycomb structure. The heat exchanger is mounted inside the combustion chamber in order to simplify the design and minimise the unswept gas volumes, but a separate regenerator light be preferred for some applications.

The chambers are arranged in pairs, each pair comprising one compression chamber feeding cool compressed gas to one expansion chamber. The operating cycle of the pairs of chambers are separated by 180° In this embodiment, this is accomplished by an appropriate design of crankshaft 169. In each pair the expansion process in the expansion chamber leads the compression process in the compression chamber by a predetermined phase angle which in this particular embodiment is 90° Again, the phase angle is fixed by appropriate design of the crankshaft 169. In this way, compression takes place when most of the gas is in the compression chamber, and expansion takes place when most of the gas is in the expansion chamber. Also, the expansion process occurring in the expansion chamber of one pair of chambers directly drives the compression process occurring in the compression chamber of the other pair.

The operating cycle of one pair of chambers proceeds as follows, beginning with gas induction into the compression chamber. As the compression piston reaches the bottom of its stroke in the compression chamber, (i.e. farthest point from the crankshaft 169) the gas inlet port 157 opens and gas is drawn into the compression chamber as the piston moves out of the compression chamber 109. At the same time, the compressed gas inlet valve 185 in the expansion chamber is closed and fuel is injected into the expansion chamber 119 as the expansion piston reaches mid-stroke moving out of the expansion chamber. The mixture of fuel and gas in the expansion chamber ignites and the combustion gases expand driving the expansion piston to the top of its stroke, (i.e. nearest point relative to crankshaft 169).

The expansion piston reverses direction and the exhaust valve 191 opens and the exhaust gases pass through the regenerator 125 and are expelled through the exhaust port 189. Gas continues to be drawn into the compression chamber until the compression piston reaches the top of its stroke when the gas inlet valve 157 closes. The compression piston reverses direction and moves into the compression chamber at which point cool liquid is sprayed into the chamber cooling the gas during compression.

As the compression piston reaches mid-stroke, the expansion piston reaches the bottom of its stroke in the expansion chamber and reverses direction. At this point the exhaust valve 191 closes and the compressed gas inlet valve 185 opens, allowing cool compressed gas from the compression chamber to flow into the expansion chamber. The compressed gas passes through the regenerator 125 in which it is pre-heated with heat from the exhaust gases.

As the compression piston in the compression chamber reaches the bottom of its stroke, the compressed gas inlet valve 185 in the expansion chamber 119 closes and fuel is injected into the expansion chamber, mixes with the pre-heated compressed gas and ignites. The combustion gas expands forcing the expansion piston to the top of its stroke and the cycle is repeated. Liquid removed from the compressed gas before leaving the compression chamber is forced out of the compression chamber through valve 205. The liquid is cooled in the cooler 197 before being returned and injected into the compression chamber.

The other pair of chambers progress through a similar cycle but as mentioned above the operating cycles of each pair are separated by 180° Such an engine could run satisfactorily if the motion was sustained throughout the cycle with a large fly wheel. However, the engine may comprise two sets of four cylinders connected to a single crankshaft, with the operation of each set of four cylinders being out of phase by 90° This would allow positive drive at all stages of the cycle, with the result that a fly wheel would not be necessary to achieve continuous operation.

In addition, it may also be possible to design an engine comprising one compression chamber and one expansion chamber as long as some means are provided to sustain the operation of the engine over the cycle period between the expansion or combustion strokes.

The orientation of an engine with solid pistons may be as shown in FIG. 6, with the crankshaft above the cylinders. This has the advantage that the separation and removal of liquid droplets from the cylinder is assisted by gravity. On the other hand it may not be so easy to provide lubrication to the crankshaft and there may be other practical disadvantages to this arrangement. An alternative arrangement is to place the crankshaft below the cylinders and to arrange the piston to push the spent spray liquid out through the valve leading to the expansion cylinder. Means of separating the liquid could then be provided in the pipe leading to the expansion chamber. An alternative method of separation for the configuration with the crankshaft below the cylinders is for the piston to push the liquid over an internal weir at the top of the cylinder. The liquid would then be drained away by gravity. This would avoid the need for a large connecting pipe and external separator.

The attraction of using solid pistons instead of liquid pistons is that it should be possible to run the engine at higher speeds. This implies a higher output for a given unit size, such that this engine could be suitable for mobile applications, for example in boats and road vehicles, in addition to static power generation. The sealing of the pistons will in general not be as good as that if liquid pistons were used, but the sealing in an open-cycle engine is not as important as it is in a closed-cycle engine. It is also possible to devise an engine comprising both liquid and solid pistons, for example with liquid pistons in the compression chambers and solid pistons in the combustion chambers.

Figure 7:
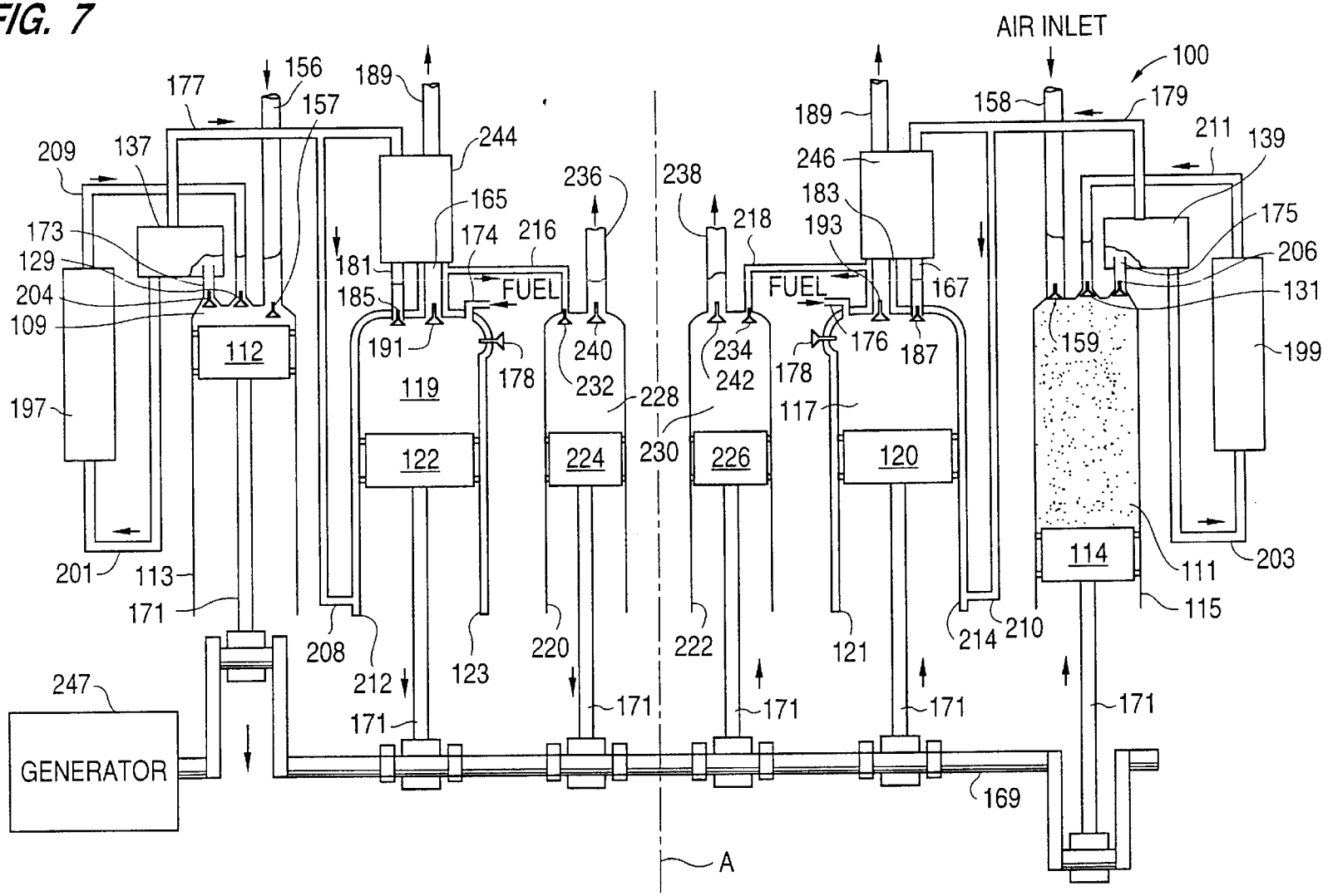
FIG. 7 shows a schematic diagram of a another embodiment of the present invention including solid pistons and which operates in an open cycle.
Figure 8:
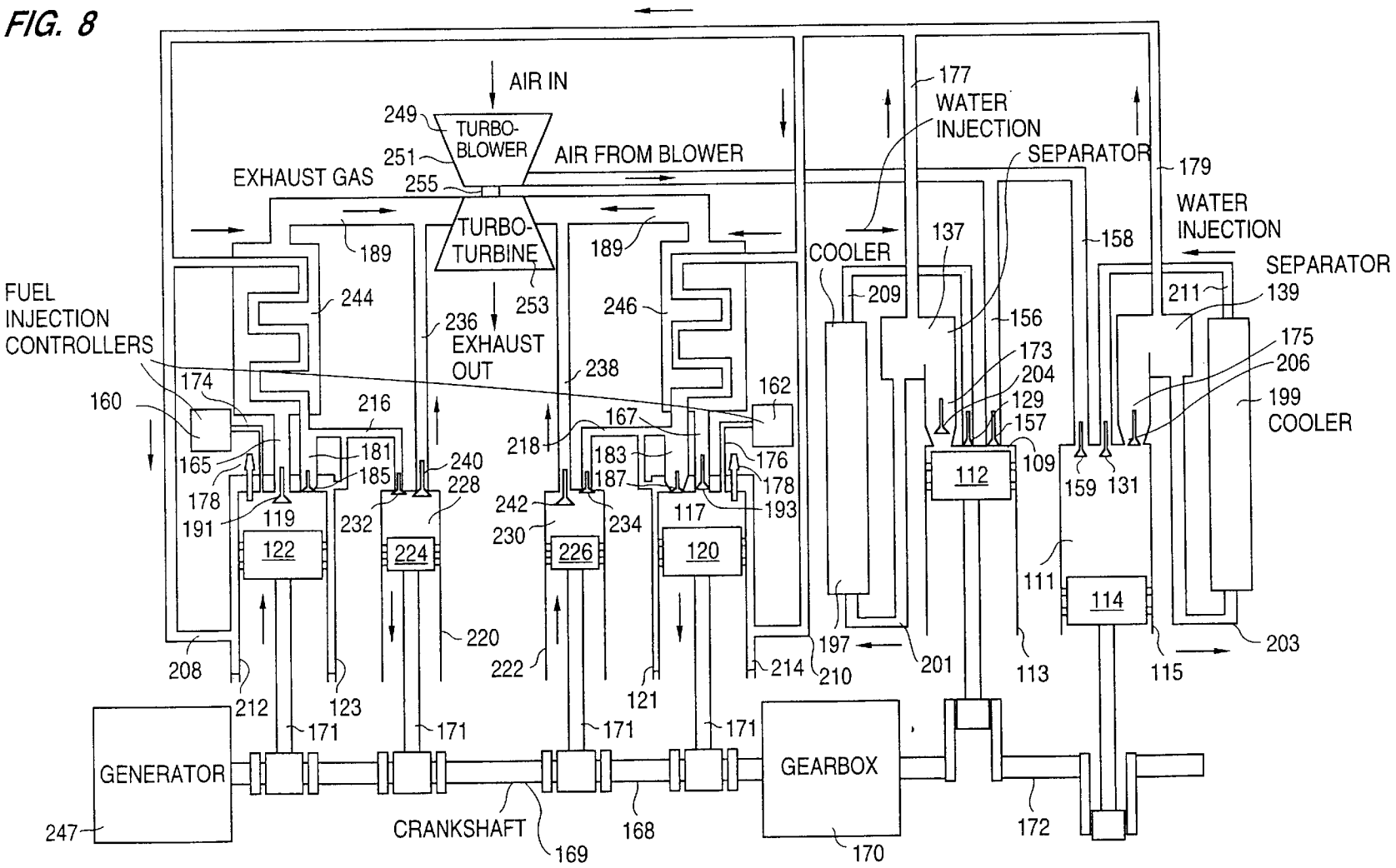
FIG. 8 shows a schematic diagram of another embodiment of the present invention including solid pistons and which operates in an open cycle.
Figure 9:
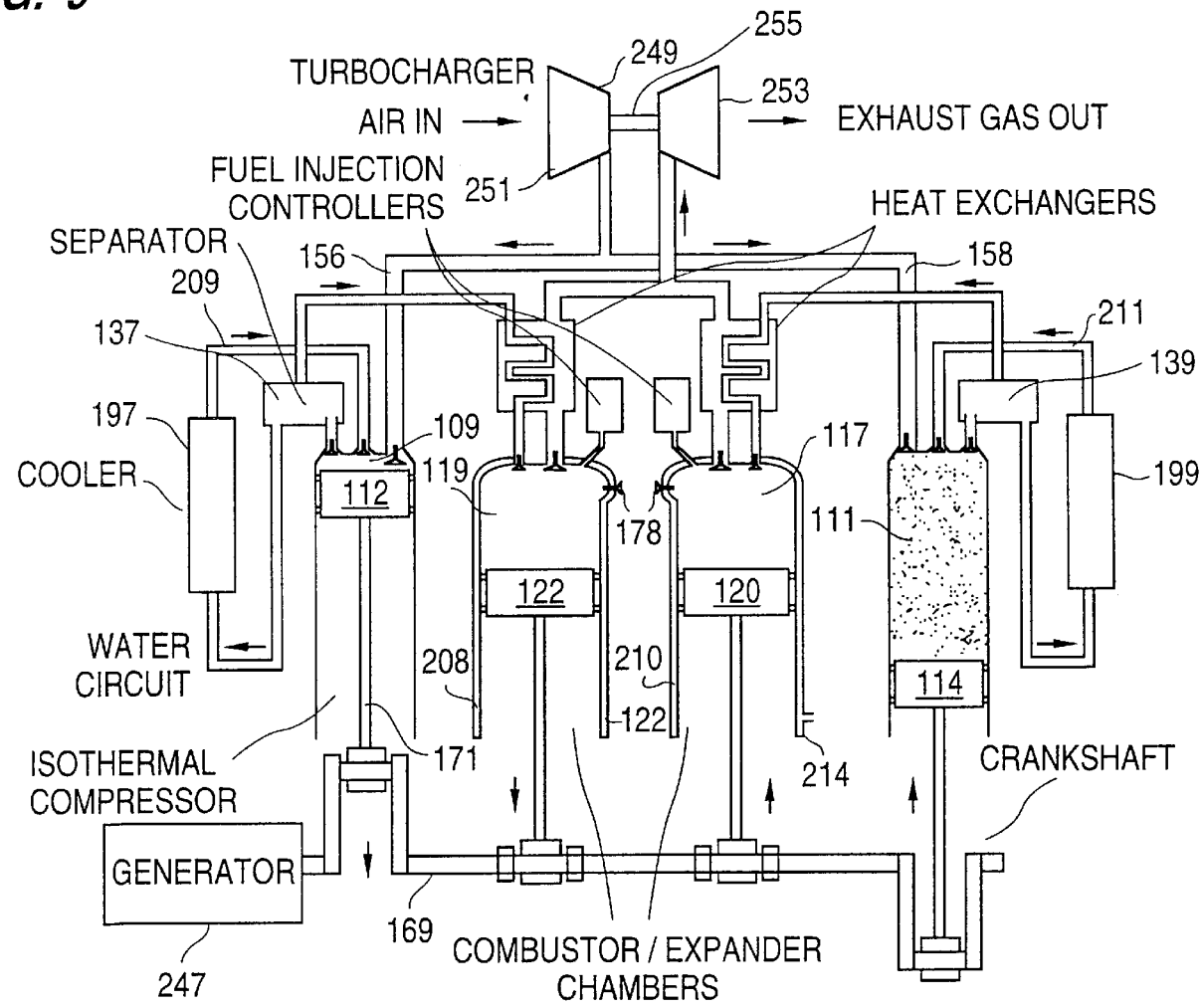
FIG. 9 shows a schematic diagram of another embodiment of the present invention including solid pistons.

FIGS. 7 to 9 show other embodiments of a heat engine which are similar to that shown in FIG. 6 but which have been modified in a number of ways for improved performance including better efficiency and a much higher output in terms of work rate.

Embodiment of the heat engine shown in FIGS. 7 to 9 comprise a pair of compression cylinders 113, 115 each having associated spray liquid cooling and re-circulating apparatus, and a pair of expansion or combustion cylinders 121, 123 and the description of these components described above in relation to the embodiment shown in FIG. 6 applies to corresponding components shown in FIGS. 7 to 9 and like components are designated by like reference numerals. The modifications to the heat engine which contribute to the improved performance of the embodiment shown in FIGS. 7 to 9, will now be described.

The moisture separators 137 and 139 have been removed from the interior of the compression chambers 109 and 111 and instead placed externally of the compression chambers and are connected in the compressed air feed lines 177, 179 between the compressed gas outlet port 173, 175 of the compression chambers and the hot compressed gas inlet ports 165, 167 of the expansion chambers 119 and 117. Placing the moisture separators outside the compression chambers removes the dead volume within the chambers which would otherwise be present throughout compression and contribute to a lower compression ratio. Compressed gas outlet valves 204 and 206 have been added to seal the compression chambers 109 and 111 from the volume enclosed by the external pipework leading from the compressed gas outlet ports 173, 175 of the compression chambers to the inlet ports of the expansion chambers, and to control the final pressure of the compressed gas in each compression chamber before the gas is passed to a respective expansion chamber and also to control the timing of the flow of compressed gas to the expansion chambers. Both the addition of the outlet valves 204 and 206 and the removal of the moisture separators from the inside of the compression chambers enables much higher compression ratios to be achieved.

The regenerative heat exchangers 125 and 127 which are housed within the expansion chambers in the embodiment shown in FIG. 6, have been replaced by recuperative heat exchangers 244 and 246 mounted externally of the expansion chambers in the embodiment shown in FIGS. 7 to 9. Again, this greatly reduces the dead volume within the expansion chambers so that the energy of expansion of the hot compressed gas admitted into the expansion chambers is not wasted by firstly expanding into the dead volume of exhaust gas, from the previous cycle, trapped within the regenerative heat exchangers, and thereby reducing the temperature of the gas. Thus, much higher temperatures can be achieved in the expansion chamber.

The recuperative heat exchangers 244 and 246 are each connected in a respective compressed gas feedline 177, 179 between a respective moisture separator 137, 139 and the hot compressed gas inlet port 181, 183 of a respective expansion chamber and are arranged to pre-heat the cool compressed gas from the compression chambers with exhaust gas leaving the expansion chambers through the exhaust ports 165, 167. The increased compression ratio obtainable from the engine shown in FIGS. 7 to 9 means that the ratio of the absolute temperatures before and after expansion is increased also. The temperature after the expansion is likely to be similar for both the engines shown in FIG. 3 and FIGS. 7 to 9 since this is determined by the materials of the heat exchanger. Hence the peak temperature of the engine shown in FIGS. 7 to 9 will be higher and the average temperature of heat addition during the expansion will be higher also. The above mentioned improvements enable both higher pressure differences and high temperatures to be achieved within the cycle, with heat being rejected at the lowest temperature within the cycle and heat being added at the highest temperature, which leads to an increase in power output.

Further modifications have been made the embodiment shown in FIGS. 7 and 8 to recover waste or excess heat in various parts of the cycle and to convert this heat into useful power, to increase the efficiency of the engine. In particular, each of the combustion cylinders 123, 121 is surrounded by a cooling jacket 212, 214 for recovering heat conducted through the combustion chamber walls. A bypass line 208, 210 is connected into the compressed gas feedline 177, 179 between the moisture separator 137, 139 and the recuperative heat exchanger 244, 246 to supply cool compressed air from the compression chamber 109, 111 to the cooling jacket 212, 214. The bypass line 208, 210 is connected near the bottom on the cooling jacket 212, 214 where the temperature of the combustion chamber walls is least. A pair of expansion cylinders 220, 222 are provided with associated pistons 224, 226 which are also connected to the crank shaft 169 via connecting rods 171. Each expansion chamber has a gas inlet port 216, 218 controlled by an inlet valve 232, 234 and a gas outlet port 236, 238 controlled by an outlet valve 240, 242. The inlet port 216, 218 is connected to a point near the top of the cooling jacket 212, 214, the uppermost part of which surrounds the exhaust port and extends to the hot side of the recuperative heat exchanger 244, 246, where the temperatures are expected to be greatest.

Thus, heat lost to the walls at the top of the combustion chamber is recovered and converted into useful work by directing part of the cool compressed gas from the compression chambers to the combustion chamber walls. Compressed air is much more effective as a cooling medium than air at atmospheric pressure. The cool compressed air enters the cooling jacket near the bottom in order to first cool the combustion chamber walls since the combustion chamber walls have to be kept below a temperature which is determined by the lubricating oil. The compressed gas is pushed upwards in the cooling jacket towards the top of the combustion chamber, absorbing heat and gradually rising in temperature. Having gained some heat in this cooling process, the compressed air is then used to cool the hotter parts of the system, such as the cylinder head and valves. Finally, the hot compressed air is intermittently extracted from the cooling system by opening the inlet valve into the expansion chamber in which it expands, driving the associated piston out of the chamber, thereby generating additional mechanical work.

Because, in practice, the heat capacity of the exhaust gas leaving the combustion chambers will generally be larger than the compressed gas from the compression chambers, there will be more heat available in the exhaust gas than is required to pre-heat the cool compressed gas in the recuperative heat exchangers. This excess heat may also be recovered by compressing more gas than is required for combustion, directing this gas through the recuperative heat exchangers in which it is pre-heated with the excess heat available in the exhaust gas and then directing this pre-heated compressed gas to one or more of the expansion chambers.

The advantage of this modification is a reduction in the final temperature of the exhuast gases, and an increase in the fuel efficiency of the engine.

One or more expansion chambers to recover waste or excess heat from various parts of the engine may also be used in any of the other embodiments described herein.

The embodiment of the heat engine shown in FIG. 7 is essentially symmetrical about the vertical centre line A with the right hand half of the engine being a mirror image of the left hand half. In this particular embodiment, the three pistons to the left of the centre line A are 180° out of phase from the three pistons to the right of the centre line, since this is expected to give the most uniform torque on the crank shaft 169. Also, the combustion chamber pistons in each half of the engine are arranged, via the crank shaft, to lead the corresponding compression chamber pistons by about 90° This will provide a high torque to the crank shaft at the time when it is needed to achieve a high pressure in the compression chamber. This arrangement also has the possible advantage that compressed air is drawn into the combustion chamber from the feed line and heat exchanger before this gas is replenished by the opening of the outlet valve from the compression chamber.

A complete operating cycle of the heat engine shown in FIG. 7 will now be described with reference to the three cylinders to the left of the centre line only, as the operation of the right hand side of the engine is essentially the same but is 180° out of phase. In this example, air is used as the oxidising gas for combustion, although this need not necessarily be the case.

When the piston 112 in the compression chamber 109 reaches the top of its stroke and begins to reverse direction, the compressed gas outlet valve 204 closes and the inlet valve 157 opens and atmospheric air is drawn into the compression chamber through the air inlet port 156. At the same time as the compression piston 112 reaches the top of its stroke, the piston 122 in the combustion chamber and the piston 224 in the expansion chamber are at the midpoint of their strokes and moving downward. The combustion chamber, at this point, contains pressurized hot combustion gases which are expanding and driving the piston out of the chamber. Likewise, the expansion chamber 228 contains hot pressurized air which is also expanding and driving the expansion piston 224 out of the chamber. The outlet valves in both the combustion chamber and expansion chamber are closed, and the inlet valves may also be closed.

As the compression piston 112 reaches the mid point of its stroke, the combustion and expansion pistons reach the bottom of their strokes and reverse direction. At this point, the exhaust outlet valve 191 in the combustion chamber and the gas outlet valve 240 in the expansion chamber both open. As the pistons move into their respective chambers, exhaust gas is expelled from the combustion chamber through the outlet port 165 and passes through the heat exchanger 244 and out into the atmosphere. Likewise, the expanded gas is pushed out of the expansion chamber through the gas outlet port 236.

Reduction of nitrogen oxides in the exhaust gases can be achieved, if desired, by injecting amonia upstream of or directly into the heat exchanger, and/or by incorporating a catalytic surface within the heat exchanger itself.

When the combustion and expansion chamber pistons 122, 224 reach the midpoint of their upward stroke, the compression piston 112 reaches the bottom of its stroke and reverses direction. At this point, the air inlet valve 157 closes and a spray of cool liquid is injected into the compression chamber 109 through the spray injection valve 129 so that the air in the compression chamber is compressed approximately isothermally.

When the combustion and expansion pistons reach the top of their stroke, their respective outlet valves 191, 240 both close and their respective air inlet valves 185, 232 open, admitting pre-heated compressed air into the chambers via a respective air inlet port 181, 216. At a predetermined point, the inlet valve supplying pre-heated compressed air into the combustion chamber is closed and fuel is injected into the chamber via the fuel injection valve 174. An ignition source 178, such as a spark plug, may be used to ignite the fuel, or the ignition may be spontaneous as the fuel mixes with the pre-heated compressed air. The piston 122 is driven out of the combustion chamber 119 by the pressure of the hot combustion gases, which cool to some degree as a result of doing work against the piston.

The gas inlet valve 232 in the expansion chamber 228 is also closed at some predetermined point and the air expands adiabatically, driving the piston 224 downward and out of the chamber.

As the piston 112 in the compression chamber 109 approaches the top of its stroke, the compressed gas outlet valve 204 opens and the mixture of air and spray liquid is expelled from the chamber into the moisture separator 137, in which the air and liquid are separated. The moisture separator 137 is sized not only to achieve separation of the air/liquid mixture, but also to act as a reservoir for the liquid and a pressure accumulator for the compressed air.

Liquid flows from the moisture separator 137 to the cooler 197 where the heat absorbed during the process of compression is liberated to the atmosphere or to some other heat sink. The liquid from the cooler 197 then flows back to the liquid spray injection valve 129 which controls the injection of liquid during compression. Since the injection of the spray will normally occur while the pressure in the compression chamber is below its maximum, it should be possible to achieve sufficient injection during this time. By the time the pressure has risen to the injection pressure and cut off the injection flow, sufficient liquid droplets will already be present in the compression chamber. Hence the compress ion chamber piston 112 can effectively provide the means to pump the liquid around the cooling circuit and through the spray injection nozzles.

Cool compressed air flows from the moisture separator 137 to the recuperative heat exchanger 224 in which it is pre-heated by the exhaust gases from the combustion chamber 119.

When the piston 112 in the compression chamber 109 has reached the top of its stroke, the compressed gas outlet valve 204 closes, the air inlet valve 157 opens and the cycle is repeated.

Phasing of the pistons in the various chambers is not too critical, particularly if the engine has a large fly-wheel to maintain its motion. However, it will generally be desirable to even out the torque on the crank shaft to minimise the operating stresses, to maintain an even motion and to minimise vibration. The phasing of the pistons will also affect the "breathing" i.e., the flow of air from the compression chamber to the combustion chamber and the pressure variations in the moisture separator and the heat exchanger. Although the phase angle between the combustion chamber pistons and the compression chamber pistons is about 90° in the embodiment shown in FIG. 4, the phase angle may be different in other embodiments, but the choice of phase angle is a matter for careful optimization in the light of practical experience and measurements.

Figure 10:
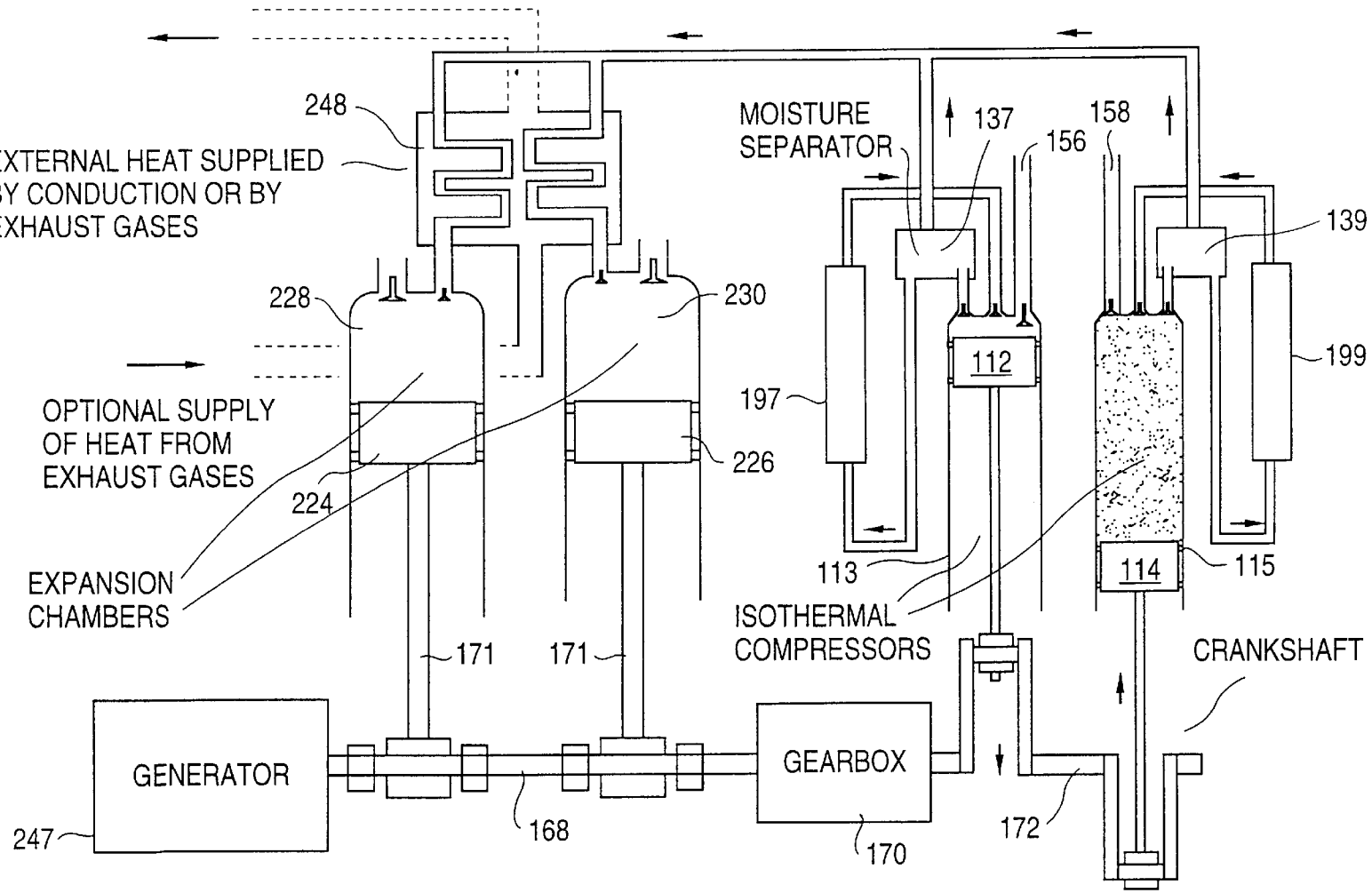
FIG. 10 shows a schematic diagram of a further embodiment of the present invention including solid pistons.

Although the embodiments shown in FIGS. 7 and 8 has two moisture separators and two heat exchangers, the heat engine may be arranged with fewer separators and/or heat exchangers so that a single separator and/or heat exchanger is shared between two or more cylinders. This may have the advantage of reducing the size of these components, improve the uniformity of air flow and possibly reduce the costs. An embodiment of a heat engine having a heat exchanger 248 shared between two expansion cylinders is shown in FIG. 10.

A further embodiment of any of the open cycle engines described above, incorporates a turbo-charger in the cycle, such as is often used for petrol and diesel engines and as shown, for example, in FIG. 9. The turbo-charger 249 may consist of a rotary compressor 251 and a rotary expander 253 on the same shaft 255. The compressor boosts the pressure of the atmospheric air before it is admitted into the isothermal compression chamber. The compressor is preferably driven by the expander, which is arranged between the exhaust outlet of the combustion chamber and the exhaust inlet to the heat exchanger. The overall effect of the turbo-charger is to raise the average pressure of the gases in both the compression and combustion chambers, so that an engine of given size has more power. The use of a turbo-charger will tend to reduce the efficiency of the engine slightly, because of the lower efficiencies of the rotary compressor and expander and because the turbo-compressor compresses adiabatically rather than isothermally. However, the incorporation of a turbo-charger may well be attractive because the reduced efficiency may be more than offset by a large increase in the power output from the same size of engine.

Although the embodiment shown in FIGS. 7 to 10 shows the crank shaft driving a generator 247, the engine could alternatively be used to drive road or rail wheels or a ship's propellor.

In an alternative embodiment, the pistons may be coupled together and driven by a rotating mechanical system other than a crank shaft, for example a hypo-cyclic gear.

In a further embodiment, it may be advantageous to arrange the engine such that the compression process in the compression chambers take place at a slower speed than combustion in the combustion chambers. In other words, the engine may be arranged such that there are more combustion cycles as shown in the embodiments of FIGS. 7 to 10 per unit time than compression cycles. This may be achieved by providing appropriate gearing 170 between the crank shaft 168 of the compression chamber and that of the combustion chamber 172. If the engine also has an air expansion chamber to recover waste or excess heat in various parts of the cycle, it is also possible to arrange the engine such that the air expansion cycle is faster than the isothermal compression cycle, as shown in FIG. 8. The advantages of such an arrangement would be that the compression process may always be maintained at a moderate rate to allow sufficient time for the transfer of heat between the gas and the liquid droplets so that the compression process may always be substantially isothermal, that the heat loss per cycle from the combustion chamber is reduced to provide higher efficiency and that the power output from the engine can be higher.

In an alternative embodiment, the present invention may be adapted to provide cooling for a conventional petrol, diesel or gas engine for the purpose of recovering heat and converting this heat into useful work. In its basic form, such an embodiment includes a compression chamber and an associated piston for compressing gas isothermally by liquid spray injection during compression, an expansion chamber and an associated piston connected either to an output drive of the engine or to some other drive which could benefit from additional power and a heat exchanger to pre-heat the cool compressed gas from the isothermal compression chamber with heat from the engine (which would otherwise be wasted) and means to feed the pre-heated compressed gas into the expansion chamber. The heat exchanger may simply consist of passages formed in the combustion chamber walls of the engine to allow the compressed air to circulate before being admitted into the expansion chamber. The isothermal compression and expansion chambers may be similar to those illustrated in FIG. 7, the main difference of this embodiment from that shown in FIG. 7 being that all the isothermally compressed air is used for heat recovery, not just a part of it. A specific embodiment of a heat engine which may be used for heat recovery in a conventional combustion engine is shown in FIG. 10. Cold compressed gas from the isothermal compression chambers 113, 115 is passed through heat exchanger 248 in which the compressed gas is heated by heat from the combustion engine, which may be heat from the exhaust gas and/or heat conducted through the surface of the combustion engine. The heated compressed gas is then expanded in the expansion chambers 228, 230 providing work to the pistons which may be arranged to drive a generator 247 or be coupled to the output drive of the combustion engine.

Any of the engines described above can readily be adapted for use with combined heat and power systems, if required. The use of a non-condensing gas as the working gas allows much greater flexibility over the choice of operating temperatures than does a condensing vapour cycle. The system is simply adjusted to reject heat at a higher temperature than would be used for power generation only.

Another option which could be used to produce the maximum amount of low temperature heat for drying, space heating or heating water, is to arrange a heat engine to drive a heat pump. The rejected heat from the engine may provide some of the low temperature heat. In addition, the mechanical output of the engine could drive a heat pump which would provide more heat. Calculations have indicated that it should be possible with an open-cycle combustion-driven engine to produce twice as much low temperature heat as is consumed in terms of the calorific value of the fuel. The additional heat may be pumped from the atmosphere, from the ground or from a large body of water.

The heat pump with both hot and cold liquid spray injection would be very suitable for domestic or commercial space and water heating. However, there would also be scope for the design of a heat pump operating at a much higher temperature. An advantage of this particular type of heat pump is that it is not tied so tightly to a particular range of temperatures as is the case for heat pumps which rely on the evaporation of a liquid and the condensation of the vapour.

Other embodiments of the heat pump may include valves so as to operate in open cycle similar to the systems shown in FIGS. 5, 6 or 7. However in this case, there would be no combustion in the expansion chamber and there may not be any form of recuperative or regenerative heat exchanger or droplet injection in the cool expansion chamber. For example, the air in the expansion chamber could be expanded adiabatically. The air in the compression chamber would be compressed isothermally by use of a piston and a droplet spray and the excess heat would be transferred to a convenient heat sink. This form of heat pump might be used as an air conditioning and ventilation unit with the expanded air leaving the system significantly cooler than the incoming air. The system would not be very suitable for the pumping of heat into a building from a cold atmosphere, because of the problem of icing inside the expansion chamber.

Further embodiments of the heat pump would be similar to those described herein but without the liquid pistons. All the compression and expansion would be performed using solid pistons only. For example, it is possible to have liquid seals without necessarily having liquid pistons.

It will be appreciated by those skilled in the art that there are many alternative mechanical arrangements for converting the linear motion of a piston to rotation of a drive shaft. Where a liquid piston is used and part of the mechanical drive comprises a drive or transmission shaft extending through a wall in the conduit, as shown in FIGS. 1 and 2, a seal must be provided between the wall and the reciprocating drive shaft. However, one possible disadvantage of this arrangement is that there may be considerable friction between the seal and drive shaft. An alternative arrangement which would perhaps reduce the friction involves a rack-and-pinion mounted within the horizontal section of the conduit. The pinion would be rotatably mounted with its axis transverse to direction motion of the piston, and the rack would be appropriately coupled or connected to the solid piston or pistons. The pinion may be arranged to drive a rotatable shaft which extends through the wall of the conduit via a seal, to transmit power from the piston externally. The solid piston which is coupled to the motion of the liquid piston would be arranged to move back and forth in one or other of the arms of the conduit and more than one such solid piston may be used within one conduit.

Alternatively, linear motion of the piston may be converted to rotational motion of the drive shaft by mounting some form of fluid screw such as a propellor or turbine blade inside the conduit which is rotatably mounted on a drive shaft extending through the conduit. In this case the drive shaft is parallel to the direction of motion of the piston. Where reciprocating drive shafts are used in two saddle loops, it may be convenient to couple the drive shaft of one compression loop to the drive shaft of the other expansion loop. A hydraulic drive system may be used instead of a mechanical system. Thus, in the above case, each combined drive shaft of the saddle loop would drive an external reciprocating piston in an external hydraulic cylinder to pump hydraulic fluid. The predetermined phase angle (for example 90°) between the two combined drive shafts could be achieved by timing the opening of valves in the hydraulic cylinders so as to prevent either shaft departing too far from its desired position at a particular stage of the cycle.

In the engines or heat pumps in which liquid pistons are used, solid floats may be arranged to float on the surface of the liquid pistons.

Modifications to the embodiments described will be apparent to those skilled in the art.

I claim:

1. An internal combustion engine comprising:

a compression chamber to contain gas to be compressed;

a first piston to compress said gas by movement of the piston in the compression chamber;

driving means arranged to drive said first piston into the compression chamber to compress said gas;

spray forming means arranged to spray liquid directly into said compression chamber to cool the gas on compression therein, said spray forming means being arranged to deliver a sufficient quantity of liquid into said compression chamber such that the heat of compression is transferred to the spray liquid by convection and absorbed into the spray liquid substantially as sensible heat, the spray liquid remaining substantially in the liquid state to the end of compression in said compression chamber;

separator means arranged to separate the spray liquid from the compressed gas/spray liquid mixture leaving said compression chamber;

an expansion chamber;

a second piston to allow gas to expand by movement of the second piston out of the expansion chamber;

transmission means comprising a solid member operatively coupled to said second piston to permit power from the engine to be drawn;

first means arranged to feed from said separator means to said expansion chamber compressed gas for combustion in said expansion chamber; and second means to deliver combustible fuel into said expansion chamber, whereby combustion thereof in said expansion chamber with said compressed gas drives said second piston.

2. An internal combustion engine as claimed in claim 1, further comprising heat exchanger means arranged to pre-heat compressed gas from said separator means with heat from exhaust gas from said expansion chamber.

3. An internal combustion engine as claimed in claim 2, wherein said heat exchanger means comprises a recuperative heat exchanger.

4. An internal combustion engine as claimed in claim 1, further including a turbo-charger arranged to increase the pressure of gas before being admitted into said compression chamber for compression therein.

5. An internal combustion engine as claimed in claim 1, wherein said driving means includes coupling means coupled to said transmission means so that, in use, said first and second pistons move in pre-determined phase relationship.

6. An internal combustion engine as claimed in claim 5, wherein said driving means is operatively coupled to said transmission means such that said second piston driven by a combustion of gas in said expansion chamber drives said first piston into said compression chamber.

7. An internal combustion engine as claimed in claim 6, further comprising a crankshaft operatively coupled to at least one of said driving means and said transmission means.

8. An internal combustion engine as claimed in claim 7, comprising a first crankshaft coupled to said first piston and a second crankshaft coupled to said second piston.

9. An internal combustion engine as claimed in claim 8, further comprising gearing coupled between first and second crankshafts and arranged such that the time to complete the compression stroke in said compression chamber is greater than the time to complete the expansion stroke in said expansion chamber.

10. An internal combustion engine as claimed in claim 9, comprising one or more compression chambers having a respective compression piston coupled to said first crankshaft and a plurality of expansion chambers each having a respective expansion piston coupled to said second crankshaft.

11. An internal combustion engine as claimed in claim 1, wherein said driving means is arranged to drive said compression piston such that the time to complete the compression stroke in said compression chamber is greater than the time to complete the expansion stroke in said expansion chamber.

12. An internal combustion engine as claimed in claim 11, wherein said driving means is arranged to drive said compression piston such that the time to complete two consecutive compressions in said compression chamber is greater than the time to complete to consecutive expansions in said expansion chamber.

13. An internal combustion engine as claimed in claim 1, including means to control the flow rate of combustible fuel into said expansion chamber.

14. An internal combustion engine as claimed in claim 1, further including valve means operative to control the flow of gas from said compression chamber into said expansion chamber.

15. An internal combustion engine as claimed in claim 14, wherein said valve means comprises outlet valve means arranged to allow gas to be drawn from said compression chamber after compression.

16. An internal combustion engine as claimed in claim 15, comprising heat exchanger means arranged to pre-heat the compressed gas from said compression chamber with exhaust gas from said expansion chamber and wherein said valve means comprises inlet valve means coupled to admit hot compressed gas from said heat exchanger means into said expansion chamber.

17. An internal combustion engine as claimed in claim 1, wherein said expansion chamber is a first expansion chamber, further including a second chamber to contain gas to be expanded and a third piston to allow said gas to expand by movement of said further piston out of said further chamber, third means to feed compressed gas from said compression chamber to said second chamber, and fourth means to pre-heat the compressed gas before entry into said further chamber.

18. An internal combustion engine as claimed in claim 17, wherein said fourth means to pre-heat comprises fifth means to pre-heat compressed gas with heat conducted through at least one of the surfaces defining said expansion chamber.

19. An internal combustion engine as claimed in claim 17, wherein said fourth means to pre-heat comprises heat exchanger means arranged to pre-heat compressed gas with expanded gas from said expansion chamber.

20. An internal combustion engine as claimed in claim 17, wherein said third piston is operatively coupled to said transmission means.

21. An internal combustion engine as claimed in claim 17, including valve means operable to control the flow of compressed gas from said fourth means to pre-heat into said second chamber.

22. An internal combustion engine as claimed in claim 1, further including a drive shaft coupled between said second piston and an electricity generator.

* * * * *